US007900708B2

(12) United States Patent
Obrejanu

(10) Patent No.: US 7,900,708 B2
(45) Date of Patent: Mar. 8, 2011

(54) MULTIPLE-BLOCK DOWNHOLE ANCHORS AND ANCHOR ASSEMBLIES

(76) Inventor: Marcel Obrejanu, Calgary (CA)

( * ) Notice: Subject to any disclaimer, the term of this patent is extended or adjusted under 35 U.S.C. 154(b) by 150 days.

(21) Appl. No.: 12/257,826

(22) Filed: Oct. 24, 2008

(65) Prior Publication Data

US 2010/0101779 A1 Apr. 29, 2010

(51) Int. Cl.
*E21B 23/01* (2006.01)

(52) U.S. Cl. ..... 166/382; 166/216; 166/243

(58) Field of Classification Search ..... 166/382, 166/216, 243

See application file for complete search history.

(56) References Cited

U.S. PATENT DOCUMENTS

| | | | |
|---|---|---|---|
| 4,669,555 | A | 6/1987 | Petree |
| 4,739,843 | A | 4/1988 | Burton |
| 4,811,785 | A | 3/1989 | Weber et al. |
| 4,886,130 | A | 12/1989 | Evans |
| 4,901,795 | A | 2/1990 | Phelps et al. |
| 5,275,239 | A | 1/1994 | Obrejanu et al. |
| 5,350,013 | A | 9/1994 | Jani et al. |
| 5,623,991 | A | 4/1997 | Jani et al. |
| 5,636,690 | A | 6/1997 | Garay et al. |
| 5,909,770 | A | 6/1999 | Davis |
| 6,041,859 | A | 3/2000 | Blades |
| 6,062,309 | A | 5/2000 | Gosse et al. |
| 6,073,693 | A | 6/2000 | Aldridge et al. |
| 6,085,837 | A | 7/2000 | Massinon et al. |
| 6,155,346 | A | 12/2000 | Aldridge et al. |
| 6,189,610 | B1 | 2/2001 | LaClare et al. |
| 6,318,459 | B1 | 11/2001 | Wright et al. |
| 6,318,462 | B1 | 11/2001 | Tessier et al. |
| 6,464,013 | B2 | 10/2002 | Bystedt |
| 6,679,335 | B2 | 1/2004 | Slack et al. |
| 6,681,853 | B2 | 1/2004 | Doyle et al. |
| 6,968,897 | B2 | 11/2005 | Doyle et al. |
| 7,121,350 | B2 | 10/2006 | Aldridge et al. |
| 2002/0014335 | A1 | 2/2002 | Doyle et al. |
| 2003/0188861 | A1 | 10/2003 | Doyle et al. |

FOREIGN PATENT DOCUMENTS

| | | |
|---|---|---|
| CA | 933089 | 9/1973 |
| CA | 1180594 | 1/1985 |
| CA | 1274470 | 9/1990 |
| CA | 1281998 | 3/1991 |

(Continued)

OTHER PUBLICATIONS

International Search Report for PCT/CA2009/001497, dated Dec. 30, 2009 (3 pages).

*Primary Examiner* — Hoang Dang
(74) *Attorney, Agent, or Firm* — Wilmer Cutler Pickering Hale and Dorr LLP

(57) ABSTRACT

Multiple-block downhole anchors and anchor assemblies are provided. A downhole anchor assembly for a tubing string includes an anchor block, a drag block, a biasing arrangement, and a mandrel to be coupled to the tubing string. The anchor block moves, with rotation of the mandrel, between a run position out of contact with a well bore and a set position in contact with the well bore to set the downhole anchor assembly in the well bore. The drag block contacts the well bore at least when the anchor block is out of contact with the well bore. The biasing arrangement biases the anchor block away from the well bore and the drag block toward the well bore. The anchor block is thus protected from the well bore by the drag block, and the biasing arrangement provides for automatic un-setting of the anchor block when torque is removed from the mandrel.

19 Claims, 47 Drawing Sheets

FOREIGN PATENT DOCUMENTS

| | | |
|---|---|---|
| CA | 2088757 | 8/1993 |
| CA | 2077990 | 3/1994 |
| CA | 2159657 | 5/1997 |
| CA | 2162409 | 5/1997 |
| CA | 2188175 | 5/1997 |
| CA | 2177762 | 12/1997 |
| CA | 2227057 | 12/1997 |
| CA | 2220392 | 5/1999 |
| CA | 2231614 | 9/1999 |
| CA | 2241358 | 12/1999 |
| CA | 2356184 | 6/2000 |
| CA | 2264467 | 9/2000 |
| CA | 2381212 | 2/2001 |
| CA | 2634315 A1 | 2/2001 |
| CA | 2281327 | 3/2001 |
| CA | 2310198 | 11/2001 |
| CA | 2451358 | 1/2003 |
| CA | 2373734 | 3/2003 |
| CA | 2386026 | 3/2003 |

Blocks Collapsed

Blocks Free

Run

Set

Blocks Collapsed

Blocks Free

Run

Set

Blocks Collapsed

Blocks Free

Run

Set

Blocks Collapsed

Blocks Free

Set

MULTIPLE-BLOCK DOWNHOLE ANCHORS AND ANCHOR ASSEMBLIES

FIELD OF THE INVENTION

This invention relates generally to downhole equipment for production wells and, in particular, to downhole anchors and anchor assemblies for such equipment.

BACKGROUND

Torque anchor assemblies are used in applications where rotation of tubular elements or tools in a downhole well environment is not desirable and is to be prevented. One primary application of such anchor assemblies is in conjunction with Progressive Cavity (PC) pumps, to prevent a tubing string from rotating in a certain direction when a pump is working. In some production wells, for example, if a PC pump's stator or the tubing string is allowed to turn to the right, joints in the tubing string can be loosened and the pump and/or the tubing can be lost in the well.

A torque anchor assembly is typically run in a well to the depth where it is required, and set by applying either right- or left-hand torque to a mandrel through the tubing string. Some sort of anchor element is pushed outward by the mandrel, to contact the well bore or casing. Many different types of torque anchor assemblies are currently available. However, the actual anchor elements tend to be substantially unprotected from the casing or well bore during positioning of a torque anchor assembly and are thus subject to wear.

SUMMARY OF THE INVENTION

Some embodiments of the invention provide a protected torque anchor assembly having one or more anchors which are set by applying right hand torque to a mandrel and prevent right hand rotation. When the torque is released, each anchor automatically disengages the casing and re-sets itself in a run position to be moved in a well or pulled to the surface.

According to one aspect of the invention, a downhole anchor assembly for a tubing string is provided. The anchor assembly includes a mandrel to be coupled to the tubing string; an anchor block coupled to move, with rotation of the mandrel, between a run position out of contact with a well bore and a set position in contact with the well bore to set the downhole anchor assembly in the well bore; a drag block, coupled to the mandrel, to contact the well bore at least when the anchor block is out of contact with the well bore; and a biasing arrangement to bias the anchor block away from the well bore and the drag block toward the well bore.

The anchor block may be coupled to move from the run position toward the set position with rotation of the mandrel in a predetermined direction.

In some embodiments, the mandrel is rotated in the predetermined direction by applying a torque to the mandrel, and the biasing arrangement is coupled to move the anchor block from the set position toward the run position when the torque is removed from the mandrel.

The drag block and the anchor block may include respective spring seat surfaces, in which case the biasing arrangement may include at least one spring, such as a coil spring or a leaf spring, positioned between the spring seat surfaces.

Where the drag block includes multiple spring seat surfaces and the anchor block includes a plurality of spring seat surfaces opposed to the plurality of spring seat surfaces of the drag block, the biasing arrangement may include multiple springs respectively positioned between opposed pairs of the plurality of spring seat surfaces of drag block and the plurality of spring seat surfaces of the anchor block.

The anchor block includes a structure to engage a shoulder on the mandrel in some embodiments. The shoulder moves the anchor block from the run position toward the set position with rotation of the mandrel in a predetermined direction and allows the biasing arrangement to move the anchor block from the set position toward the run position with rotation of the mandrel in a direction opposite to the predetermined direction.

The structure of the anchor block and the shoulder of the mandrel may be shaped to limit movement of the anchor block with rotation of the mandrel in the predetermined direction.

In some embodiments, the downhole anchor assembly includes multiple anchors. Each anchor includes a drag block coupled to the mandrel, an anchor block coupled to move between the run position and the set position with rotation of the mandrel, and a biasing arrangement to bias the drag block toward the well bore and the anchor block away from the well bore.

A housing may also be provided to at least partially enclose the mandrel, the drag block, and the anchor block. The mandrel is rotatable relative to the housing, and the drag block is coupled to the mandrel by the housing. The drag block and the biasing arrangement may then retain the anchor block in contact with the mandrel.

The downhole anchor assembly may also include bearings positioned between the housing and the mandrel. The bearings connect the housing to the mandrel and allow the mandrel to rotate relative to the housing. A guide screw may be installed in a bore in the mandrel to engage a slot in the housing, such that the guide screw and the slot limit an extent of relative rotation between the mandrel and the housing.

In some embodiments, the downhole anchor assembly includes a pair of retaining rings coupled to the mandrel. The drag block is coupled to the mandrel by the pair of retaining rings, and the drag block and the biasing arrangement retain the anchor block in contact with the mandrel.

A method is also provided, and includes connecting a mandrel of an anchor assembly to a tubing string of a production well, the anchor assembly further comprising an anchor block coupled to move, with rotation of the mandrel, between a run position out of contact with a well bore of the production well and a set position in contact with the well bore to set the downhole anchor assembly in the well bore; a drag block, coupled to the mandrel, to contact the well bore at least when the anchor block is out of contact with the well bore; and a biasing arrangement to bias the anchor block away from the well bore and the drag block toward the well bore; moving the anchor assembly, with the anchor block in the run position, to a desired downhole location; and rotating the tubing string to move the anchor block into the set position to set the anchor assembly at the desired downhole location.

Rotating may involve rotating the tubing string to apply a torque to rotate the mandrel in a predetermined direction. The method may also include removing the torque from the mandrel, to thereby allow the biasing arrangement to move the anchor block from the set position to the run position and release the anchor assembly.

In some embodiments, the method also includes moving the anchor assembly, with the anchor block in the run position, to a second desired downhole location; and rotating the tubing string in the predetermined direction to move the anchor block into the set position to set the anchor assembly at the second desired downhole location.

A downhole anchor is also provided, and includes an anchor block for moving, with rotation of a mandrel, between a run position out of contact with a well bore and a set position in contact with the well bore to set the downhole anchor assembly in the well bore; a drag block, coupled to the anchor block, for contacting the well bore at least when the anchor block is out of contact with the well bore; and a biasing arrangement to bias the anchor block away from the well bore and the drag block toward the well bore.

The drag block and the anchor block may include respective spring seats, in which case the biasing arrangement may include at least one spring, illustratively a coil spring or a leaf spring, positioned between the spring seats.

Other aspects and features of embodiments of the present invention will become apparent to those ordinarily skilled in the art upon review of the following description.

BRIEF DESCRIPTION OF THE DRAWINGS

Examples of embodiments of the invention will now be described in greater detail with reference to the accompanying drawings.

DETAILED DESCRIPTION OF PREFERRED EMBODIMENTS

Figure 1:
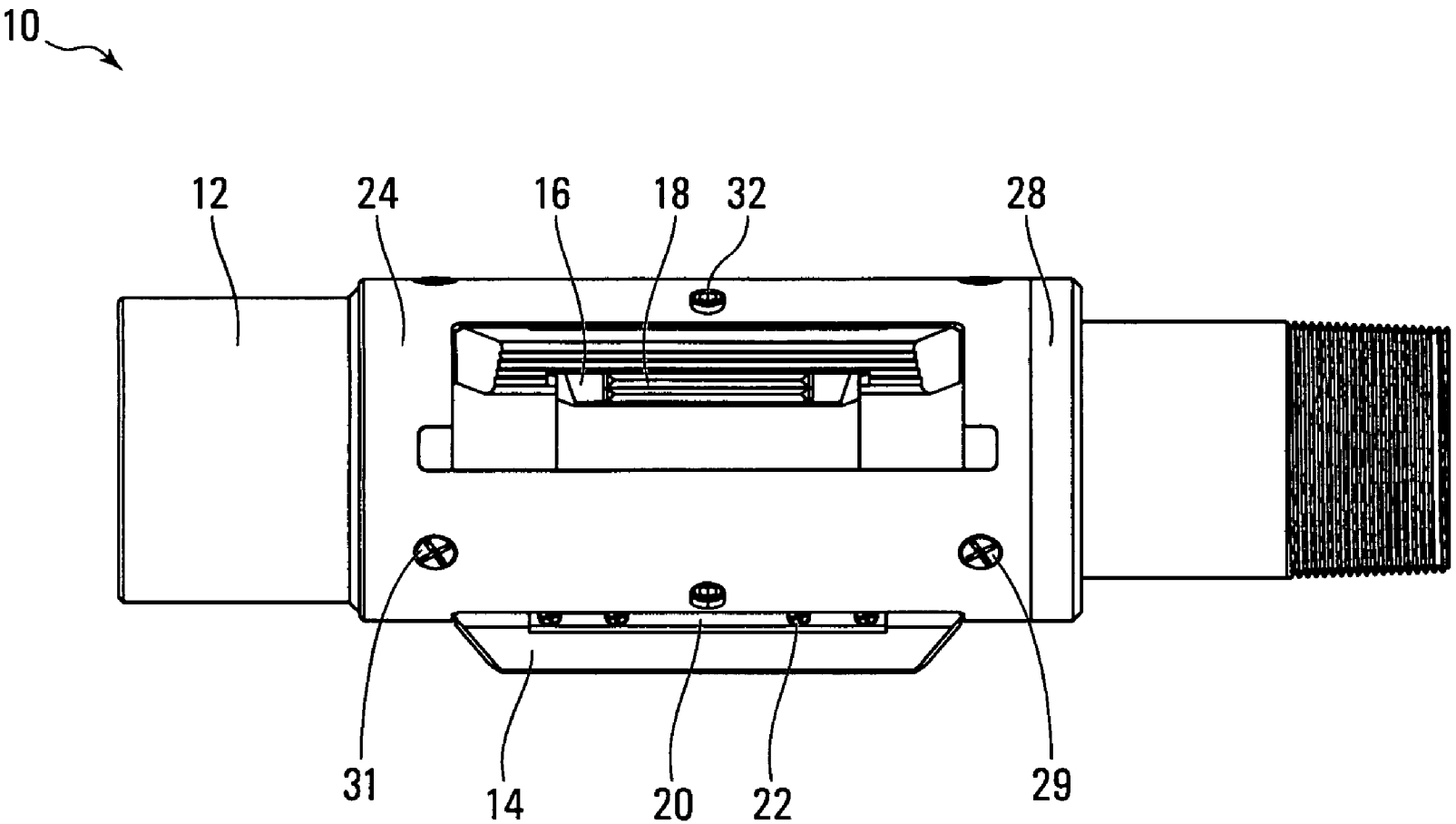
FIG. 1 is a side view of an example anchor assembly according to an embodiment of the invention.

As noted above, anchor elements in currently available torque anchor assemblies tend to be substantially unprotected from a casing or well bore during positioning the anchor. A dual-block anchor configuration, including an anchor block and a drag block which work together, protects the anchor block and may also provide further advantages, such as an automatic release function.

A dual-block anchor according to embodiments of the invention includes a drag block, an anchor block, and a biasing arrangement. In one embodiment, the biasing arrangement includes springs and a spring retaining plate.

Those skilled in the art will appreciate that production wells may include a casing that is constructed inside a well bore. Although features of embodiments of the present invention are disclosed and claimed herein primarily with reference to a well bore, it is to be appreciated that such references are intended to include well bores that have casings. References herein to well bores should be interpreted accordingly. For example, references to contact with a well bore are intended to include contact with the inside wall of the well bore or with the inside wall of a casing in the well bore if a casing is provided.

One function of the drag block is to protect the anchor block, while running the tool in and out of a well. The biasing arrangement, illustratively one or more springs, pushes the anchor block inwards, away from the well bore and toward a mandrel, and also pushes the drag block outwards, toward the well bore and away from the mandrel. Where a spring retaining plate is provided, this plate retains the springs, illustratively in cavities in the anchor block and the drag block, and prevents sand and other materials that may be present in a well from getting into the spring cavities.

The anchor block, which is biased away from the well bore and toward the mandrel by the biasing arrangement, is pushed outwards by the rotation of the mandrel, to contact the well bore, and to prevent rotation of the anchor assembly.

While the anchor assembly is being run in or out of a well, the drag block, which is being pushed outwards and is in constant contact with the well bore, does not allow engagement of the anchor block with the well bore. While the anchor assembly is travelling into or out of the well, top and bottom tapered shoulders on the drag block allow the drag block to remain a run position. At the same time, the anchor block is being pushed inwards, and the combined action of the anchor block, the drag block, and the biasing arrangement keep the anchor assembly in the run or "un-set" position, with the anchor block protected. The drag block is thus in contact with the well bore at least when the anchor block is out of contact with the well bore, i.e., while the anchor assembly is being run in or out of a well or even when the anchor assembly is not being moved but is also not set. The drag block also need not necessarily be moved out of contact with the well bore when the anchor assembly is set. In this case, the drag block may remain in contact with the well bore even when the anchor block is also in contact with the well bore.

When the anchor assembly has reached a desired location in the well, torque is applied to the mandrel through a tubing string. The drag block will remain in stationary contact with the well bore and the rotation of the mandrel will cause the anchor block to emerge into its set position, in which it contacts the well bore. At this point, relative rotation between the anchor assembly and the well bore is stopped. The anchor block will remain in the set (engaged) position as long as torque is applied to the mandrel. When the torque is released, the biasing arrangement will push the anchor block inward, toward the mandrel, the drag block will be pushed outward, against the well bore, and the tool is automatically released (un-set).

Illustrative embodiments of the invention are described in further detail below with reference to the drawings. The illustrative embodiments include the following four different configurations: a multiple anchor or "multi set" assembly with housing (FIGS. 1 to 10E), a multi set assembly with no housing (FIGS. 12 to 19E), a single anchor or "single set" assembly with bearings (FIGS. 20 to 28E), and a single set assembly with no bearings (FIGS. 29 to 37E). Other embodiments are also contemplated.

The multi set configurations are centralizing type tools that might be used mainly in vertical wells, and the single set configurations are de-centralized type tools that would likely be used mainly in horizontal wells and applications where large volumes of sand produced from a formation could build up around downhole equipment and "trap" it. The de-centralized position of a single set anchor assembly allows coiled tubing to be run downhole through a larger open portion of a well bore, for example, to wash sand out and free trapped downhole equipment.

The illustrative embodiments will now be discussed in further detail, in terms of structure and then function.

Figure 2:
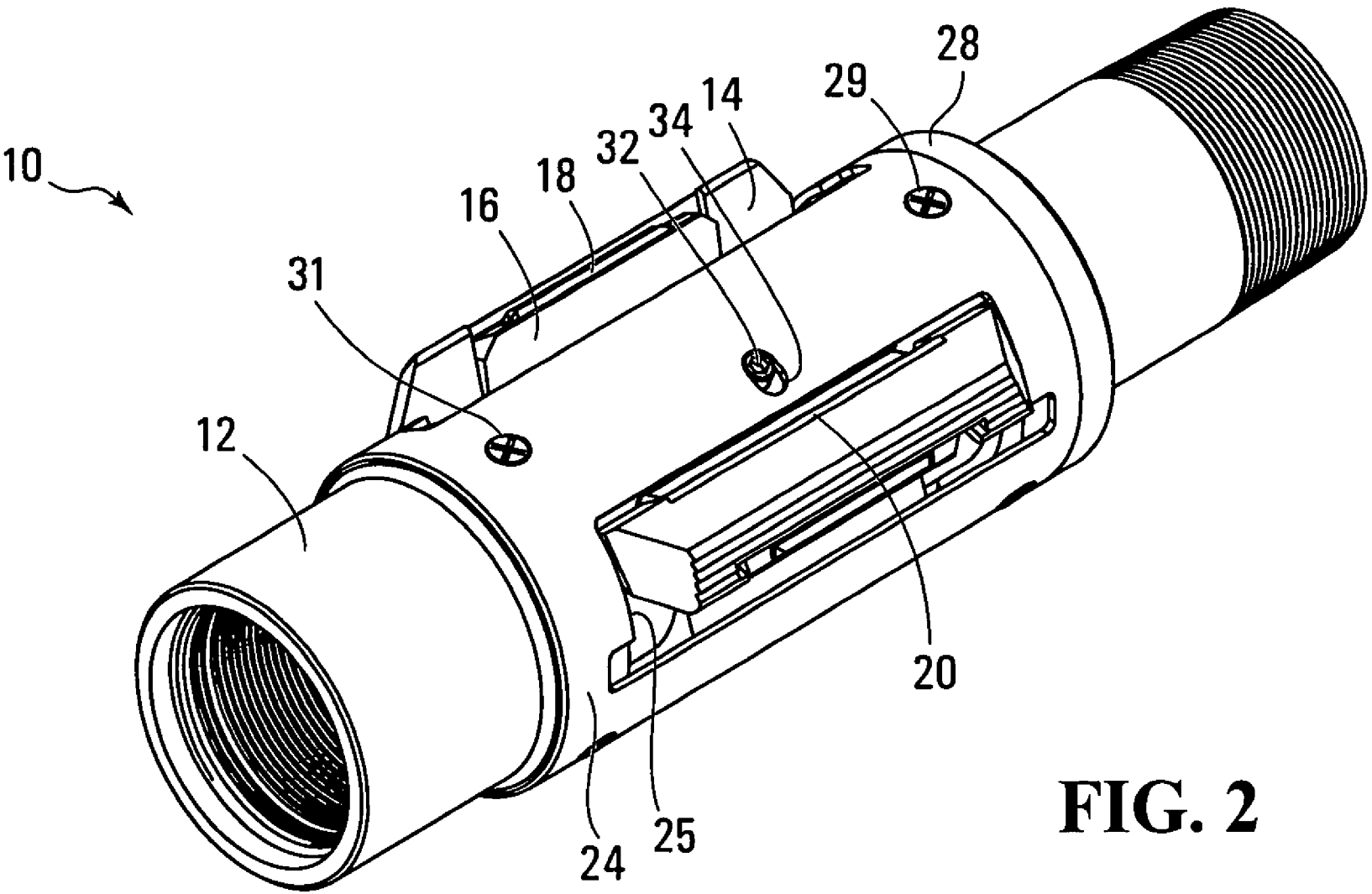
FIG. 2 is an isometric view of the example anchor assembly of FIG. 1.
Figure 3:
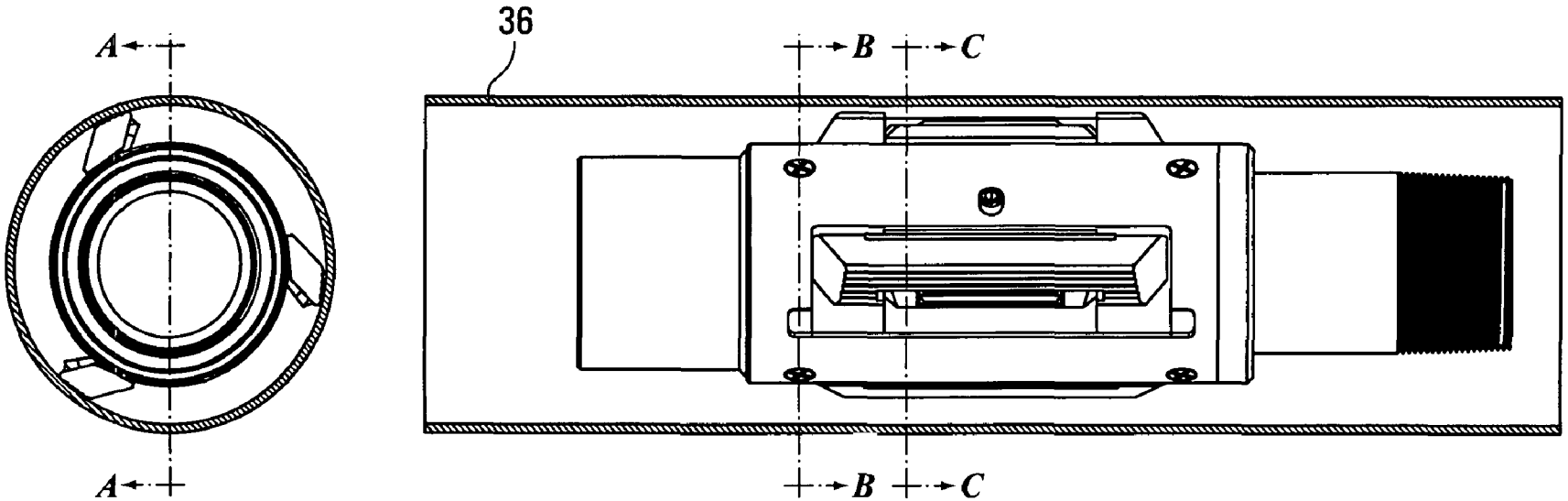
FIG. 3 includes end and side views of the example anchor assembly of FIG. 1 in a well bore.
Figure 4:
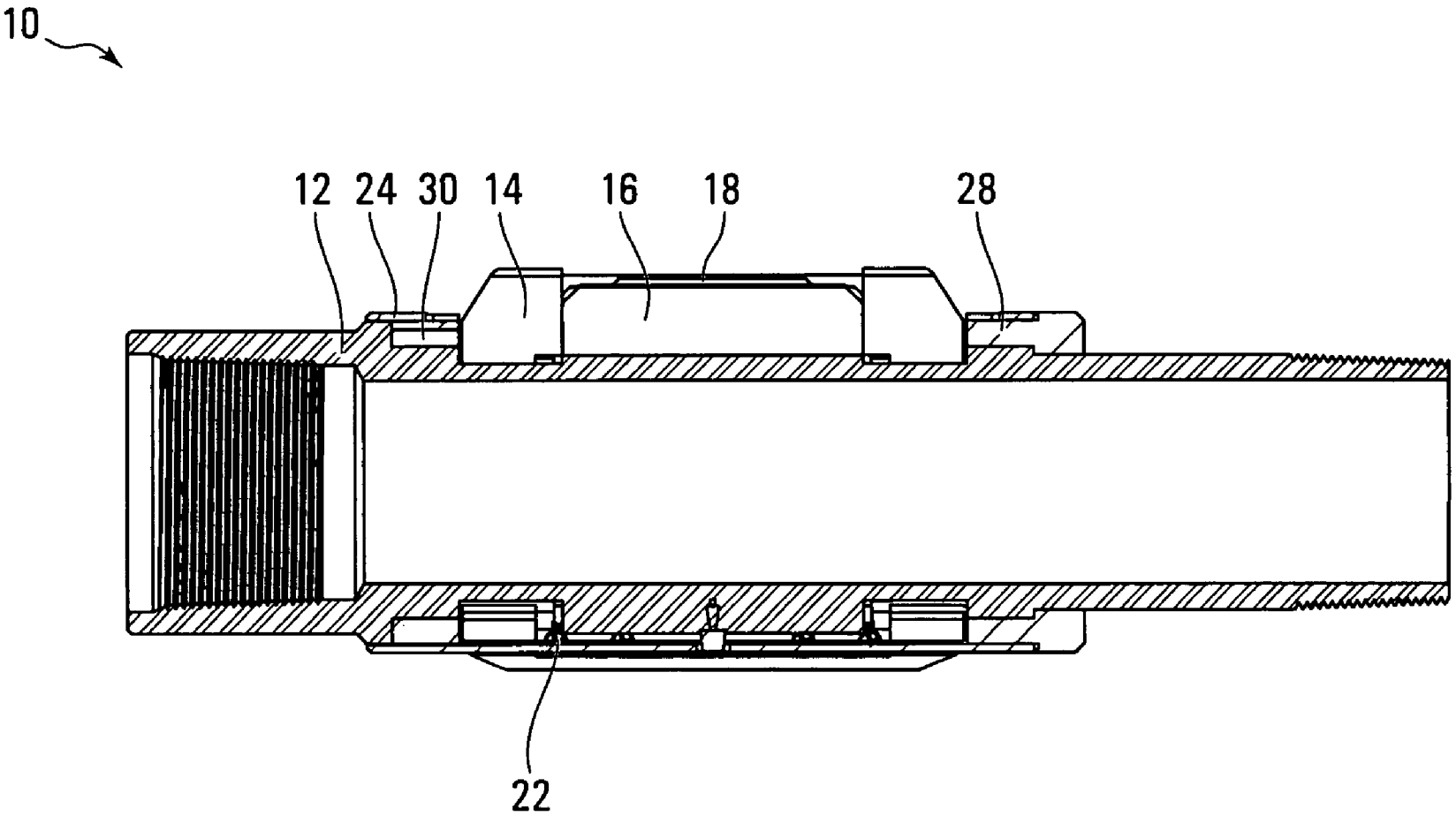
FIG. 4 is a cross-sectional view of the example anchor assembly of FIG. 1 along line A-A of FIG. 3.
Figure 5:
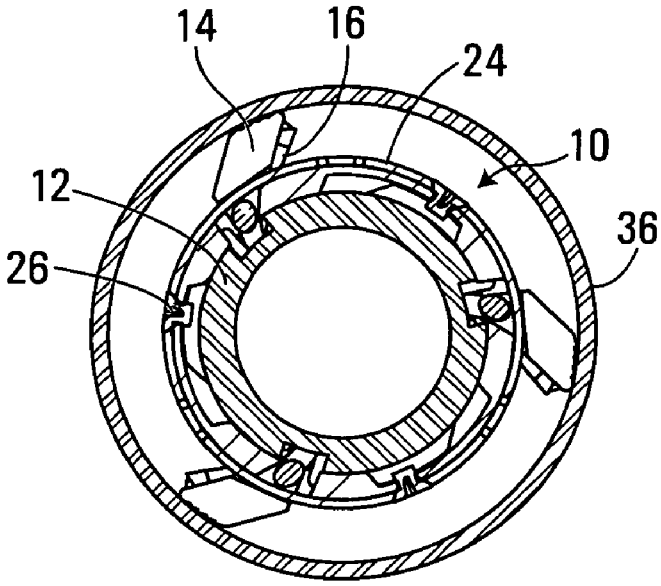
FIG. 5 is a cross-sectional view of the example anchor assembly of FIG. 1 along line B-B of FIG. 3.
Figure 6:
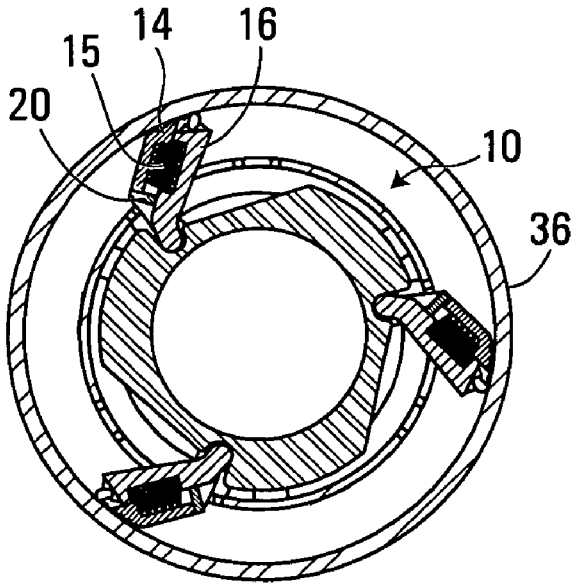
FIG. 6 is a cross-sectional view of the example anchor assembly of FIG. 1 along line C-C of FIG. 3.
Figure 7:
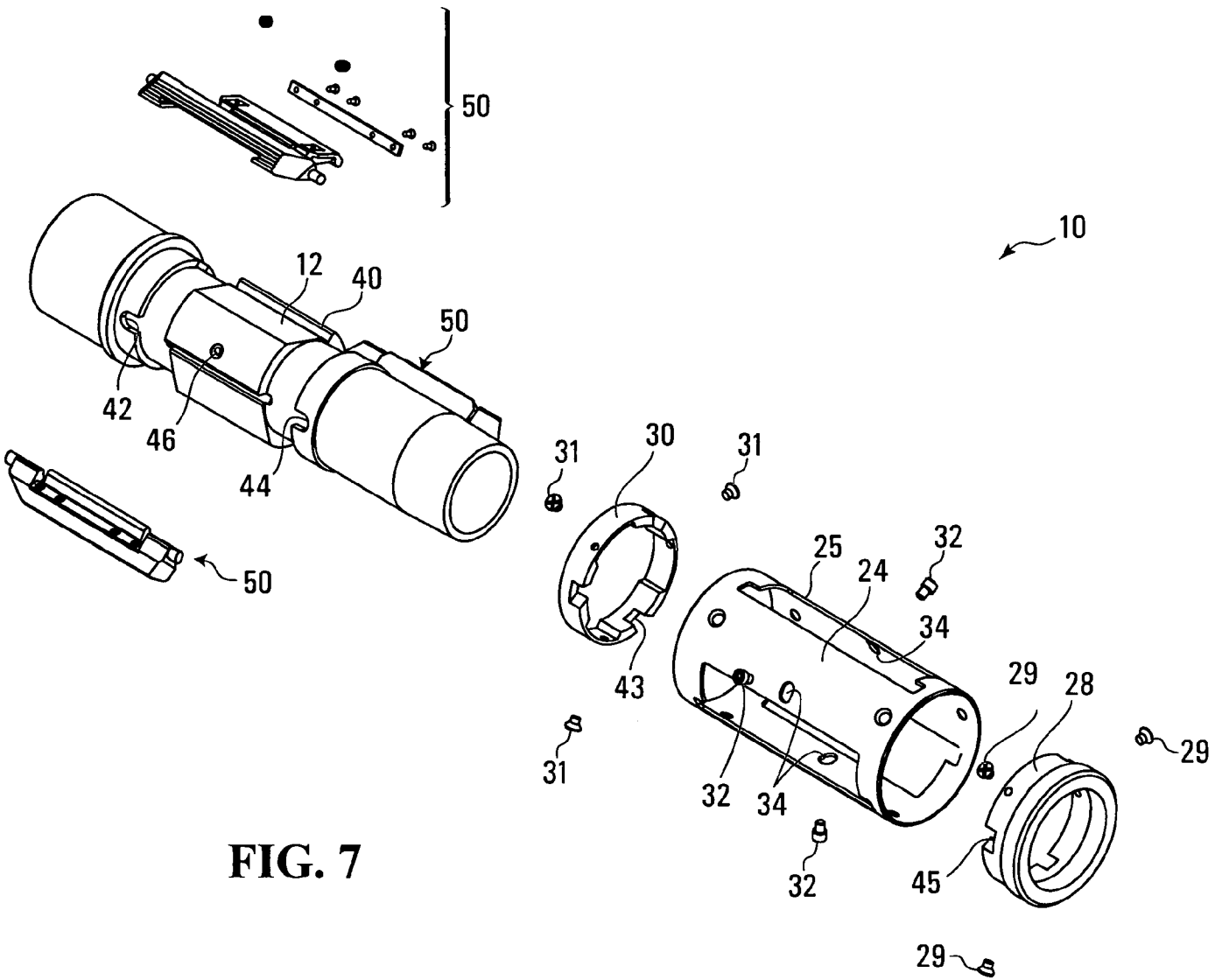
FIG. 7 is an exploded view of the example anchor assembly of FIG. 1.

An example anchor assembly 10 according to a first embodiment of the invention is shown in FIGS. 1 to 7. FIG. 1 is a side view, FIG. 2 is an isometric view, FIG. 3 includes end and side views of the example anchor assembly 10 in a well bore 36, FIGS. 4 to 6 are respective cross-sectional views along lines A-A, B-B, C-C of FIG. 3, and FIG. 7 is an exploded view.

The example anchor assembly 10 includes a mandrel 12, which would be coupled to a tubing string, a drag block 14, and an anchor block 16. The anchor block 16 may include an insert 18, illustratively a carbide insert, in some embodiments for contacting a well bore when the anchor block is in its set position. A spring retaining plate 20 is attached to the drag block 14 using fasteners 22, illustratively screws, to retain springs 15 between the drag block 14 and the anchor block 16.

A sleeve or housing 24 at least partially encloses the mandrel 12, the drag block 14, and the anchor block 16, and retains or couples the dual block anchor assembly 50 including the drag block, the anchor block, and the springs 15 to the mandrel 12. The housing 24 also includes openings 25 through which the drag block 14 and the anchor block 16 extend.

In the example shown, two bearing rings 28, 30 are positioned between the housing 24 and the mandrel 12, and are secured to the inside of the housing with fasteners 29, 31, which are screws in the example anchor assembly 10. The bearing rings, also referred to herein as bearings, have three functions: to provide easy rotation between the mandrel 12 and the housing 24, to retain the housing on the mandrel, and to provide a shoulder for the drag block 14 to sit and push against, as described in further detail below.

A guide screw 32 installed in a bore 46 of the mandrel 12 engages a slot 34 in the housing 24 to limit an extent of relative rotation between the mandrel and the housing.

The mandrel 12 includes a groove 40 for receiving a structure on the anchor block 16. The groove 40 provides a shoulder for pushing the anchor block 16 from its run or un-set position to its set position, when torque is applied to the mandrel 12. The slots 42, 44 in the mandrel 12 and the slots 43, 45 in the bearings 30, 28 receive structures on the drag block 14, to thereby retain the drag block. The slots 43, 45 in the bearings 30, 28 have slanted shoulders to bias the drag blocks 14 to extend outwards. The slots 42, 44 in the mandrel 12 create free space for extensions 52 (FIG. 8) of the drag blocks 14. As the mandrel 12 rotates to set (push outwards) the anchor blocks 16, the drag blocks 14 are already in contact with the well bore, such that the bottom of the slots 42, 44 in the mandrel are moving closer to the drag block extensions 52.

In some embodiments, the drag blocks 14 may be accommodated in slots provided only on the mandrel 12 or only in the bearings 28, 30. Where bearings have a greater radial dimension or thickness, bearing slots might provide sufficient space for the drag blocks 14, for example. Thinner bearings without slots and/or larger drag blocks having a greater dimension between their extensions 52 and the faces which contact the well bore could be used in conjunction with deeper slots in the mandrel 12. In this case, slots in the mandrel 12 might have slanted shoulders in order to bias the drag blocks 14 outwards.

Figure 8:
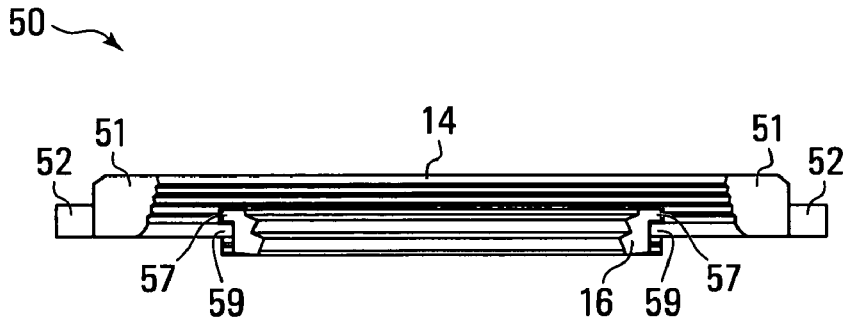
FIG. 8 is a front view of an example dual-block anchor.
Figure 9:
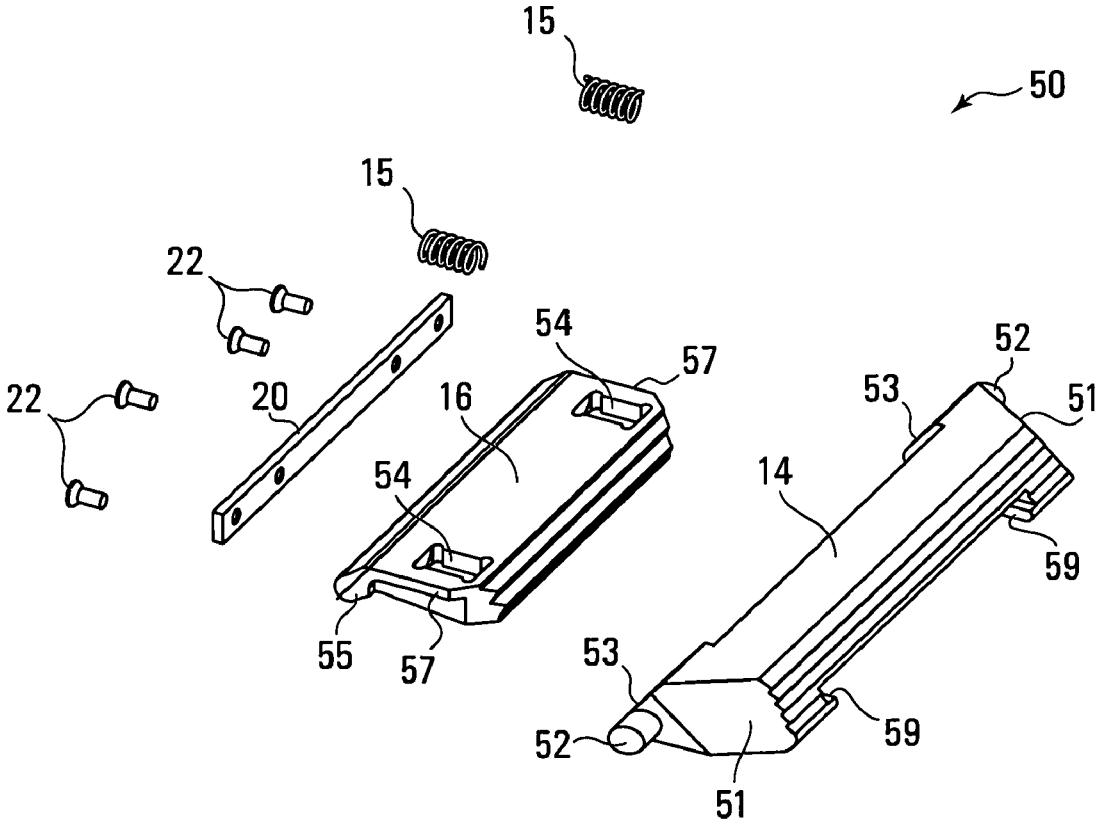
FIG. 9 is an exploded view of the example dual-block anchor of FIG. 8.

FIG. 7 shows an exploded view of one of the three dual-block anchors 50 in the example anchor assembly 10. An example dual-block anchor is shown more clearly in FIGS. 8 and 9. FIG. 8 is a front view and FIG. 9 is an exploded view of an example dual-block anchor 50.

The example dual-block anchor 50 includes a drag block 14, an anchor block 16, and a biasing arrangement including springs 15. Although shown as compression springs, the springs 15 may instead be implemented using other types of springs or biasing elements, such as leaf springs, for example. The spring retaining plate 20 is attached to the drag block 14 with fasteners 22, illustratively screws, to retain the springs 15 between the drag block 14 and the anchor block 16, and partially within the anchor block recesses 54.

Extensions 57 of the top of the anchor block 16 are received in grooves that are formed by shoulders 59 on the drag block 14 when the dual-block anchor 50 is assembled, and allow the anchor block and the drag block to slide relative to each other without separating, thereby retaining the springs 15 between the drag block and the anchor block. During assembly, the springs 15 can be placed in the cavities 54 in the anchor block 16, the drag block 14 can then be slid onto the anchor block with the extensions 57 in the grooves formed by the shoulders 59, and the spring retaining plate 20 is then attached to the drag block. The springs 15 are retained between the drag block 14, the anchor block 16, and the spring retaining plate 20. This can perhaps be appreciated most clearly with reference to FIGS. 11A and 11B.

Referring again to FIG. 9, both the drag block 14 and the anchor block 16 also include structures which cooperate with other components of an anchor assembly. The extensions 52 at each end of the drag block 14 are received in the slots 42, 44 in the mandrel 12 and the slots 43, 45 in the bearings 30, 28 and retained by the housing 24. A rear tapered surface 53 of the drag block 14 may contact an edge of the opening 25 in the housing 24 in some embodiments. The structure 55 on the anchor block 16 is received in the groove 40 on the mandrel. The dual block anchor 50 is thus located between the slots 42/43, 44/45 in the mandrel 12 and the bearings 30, 28 which receive the extensions 52 of the drag block 14, the housing 24 which covers those slots, and the groove 40 in the mandrel 12 which receives the structure 55 of the anchor block 16.

FIGS. 8 and 9 also illustrate tapered shoulders 51, which allow the drag block 14 to remain in a run position during movement in a well bore. These tapered shoulders 51 enable the drag block 14 to slide over any irregularities in a well bore, thereby facilitating movement of an anchor assembly with the drag block 14 in contact with the well bore. Although referred to above as top and bottom tapered shoulders, it should be appreciated that the shoulders 51 would be in a top and bottom orientation in a vertical well bore. Other orientations during movement of an anchor assembly are also possible, depending on the path of a well bore. For example, in a horizontal well, the tapered shoulders 51 would not strictly be oriented as top and bottom shoulders, but would still facilitate movement of an anchor assembly with any drag blocks 14 in contact with the well bore.

Operation of the example anchor assembly will now be considered in detail primarily with reference to FIGS. 10 and 11. FIG. 10A is a side view of the example anchor assembly 10, FIGS. 10B through 10E include cross-sectional views of the example anchor assembly along lines D-D and E-E of FIG. 10A, for different positions of the dual-block anchors, and FIGS. 11A and 11B include isometric and cross-sectional views of the example dual-block anchor 50 in different positions. Although only one spring 15 is shown in FIGS. 11A and 11B and described below, it will be apparent from FIG. 9, for example, that multiple springs may be provided.

Figure 10A:
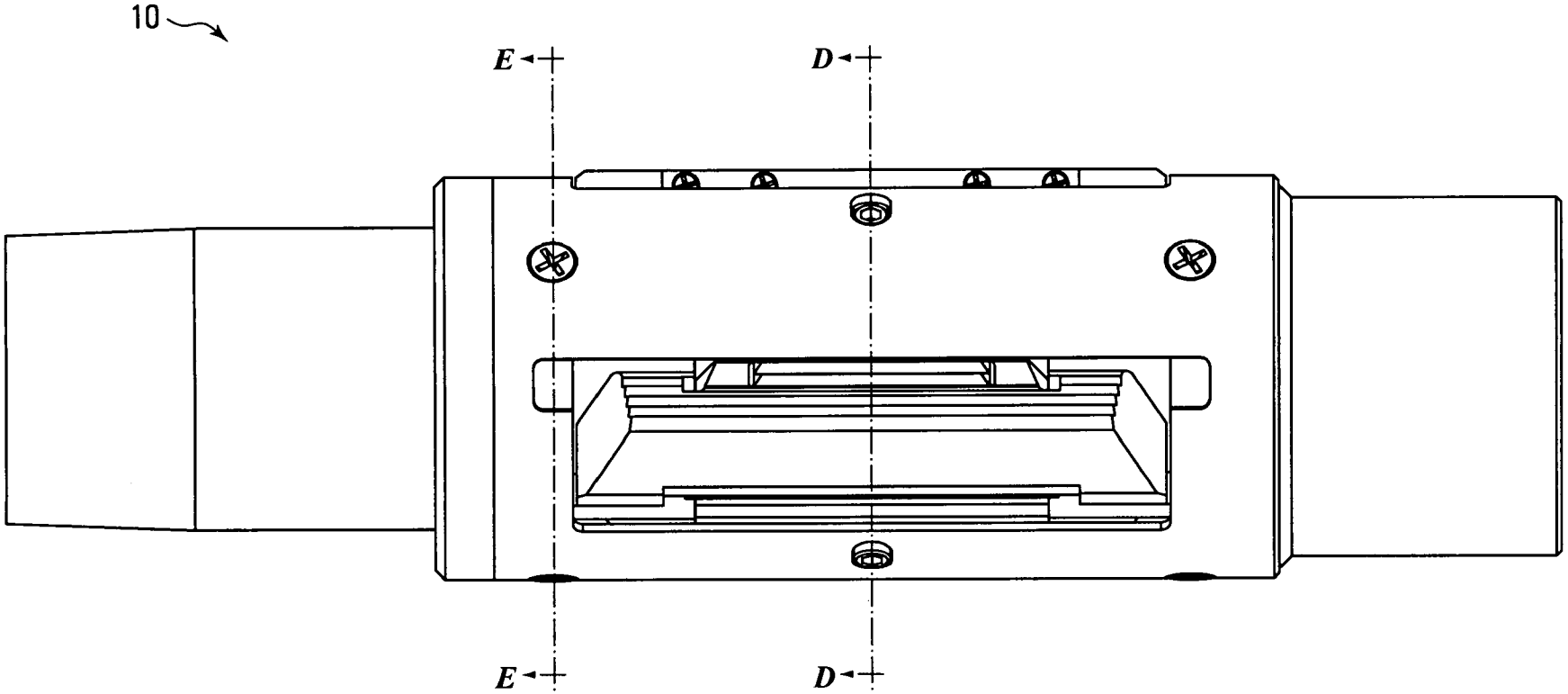
FIG. 10A is a side view of the example anchor assembly of FIG. 1.
Figure 10B:
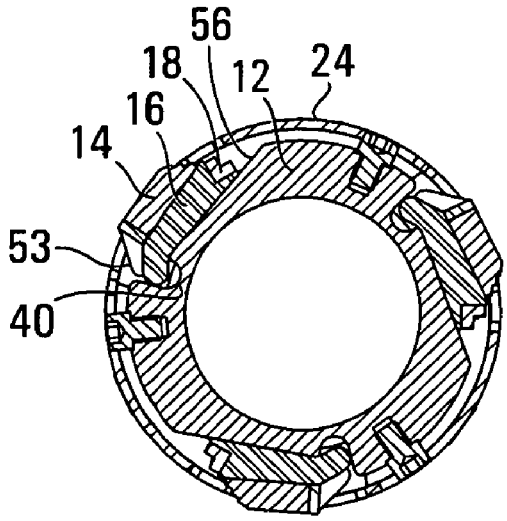
FIGS. 10B through 10E include cross-sectional views of the example anchor assembly of FIG. 1 along lines D-D and E-E of FIG. 10A, for different positions of the dual-block anchors.
Figure 10B:
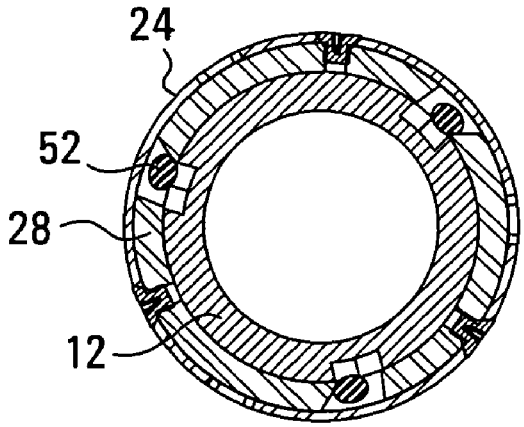

FIG. 10B shows a collapsed position of the dual-block anchors in which the anchor blocks 16 are flat on respective surfaces 56 of the mandrel 12. A dual-block anchor might be in this position, for example, when the anchor assembly is being run in a horizontal well bore and a drag block 14 is bearing the weight of the anchor assembly.

Figure 11B:
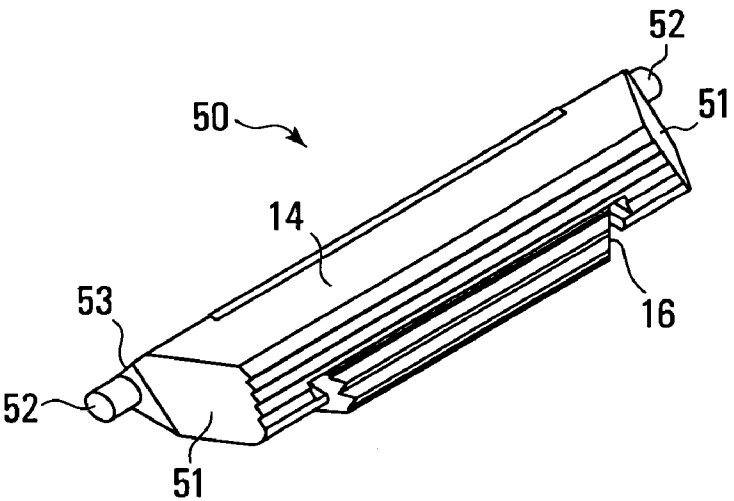
FIGS. 11A and 11B include isometric and cross-sectional views of the example dual-block anchor of FIG. 8 in different positions.
Figure 11B:
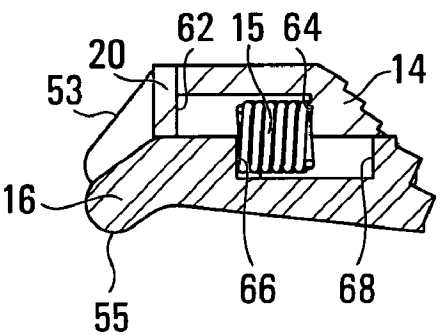
Figure 11A:
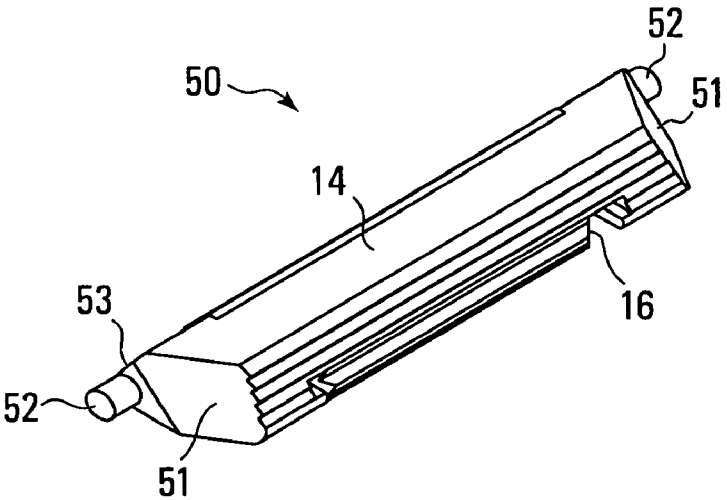
Figure 11A:
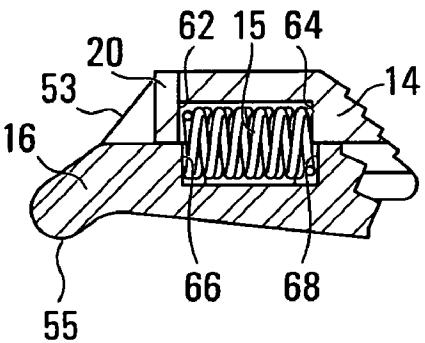

With reference also to FIGS. 11A and 11B, which respectively show the dual-block anchor 50 in a rest position and a set position, it can be seen that the dual-block anchors are not in the rest position of FIG. 11A when collapsed as shown in FIG. 10B. The anchor block 16 is actually extended when a dual-block anchor 50 is collapsed. This compresses the spring 15 between a spring seat surface 66 of the anchor block 16 and an opposed spring seat surface 64 of the drag block 14, which biases the anchor block to the left and the drag block to the right in the drawing. This in turn exerts forces on a surface of the groove 40 in which the structure 55 of the anchor block 16 is received, and side surfaces of the slots 43, 45 in which the extensions 52 of the drag block 14 are received.

It should be noted that references herein to spring seat surfaces of a drag block and/or an anchor block are intended to encompass spring seat surfaces through which spring forces are applied to those blocks. For example, although a spring retaining plate is used in some embodiments to retain one or more springs, references to spring seat surfaces of a drag block are intended to encompass spring seat surfaces of a spring retaining plate that is attached to the drag block. Thus, spring seat surfaces of a drag block or an anchor block need not necessarily be integrated into a single block component.

As shown perhaps most clearly in FIG. 11B, the force on the drag block 14 is applied at the surface 64, which is above the extensions 52 of the drag block. Since the housing 24 and the side walls of the slots 43, 45 retain the extensions 52 of the drag block 14, the rightward force on the surface 64 would tend to rotate the drag block 14 in a counter-clockwise direction, away from the surface 56 of the mandrel 12. In a similar manner, the spring 15 exerts a force on the spring seat surface 66 of the anchor block 16 in a direction above the structure 55, which contacts the surface or shoulder 58 of the groove 40 on the mandrel 12. This would also tend to rotate the anchor block 16 in a counter-clockwise direction, away from the surface 56 of the mandrel.

Figure 10C:
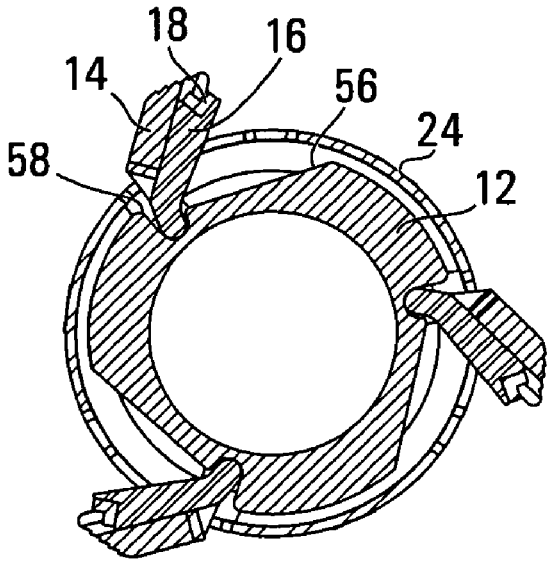
Figure 10C:
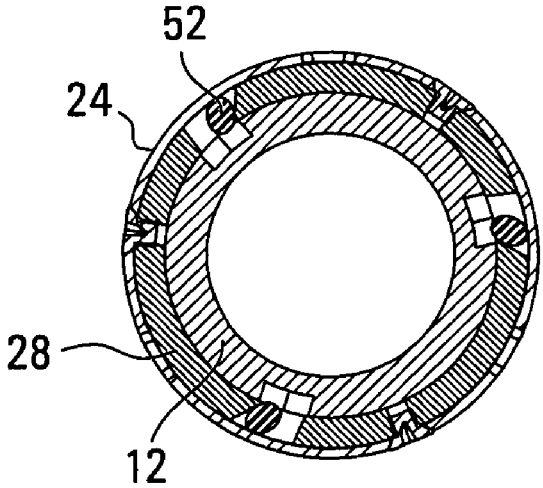

Thus, the dual-block anchors 50 in the example anchor assembly 10 would not normally remain in the collapsed position shown in FIG. 10B. FIG. 10C shows a free position of the dual-block anchors 50.

In the free position of the dual-block anchors 50, the spring 15 in each anchor block may remain compressed or be at rest. As noted above, the guide screw 32 and the slot 34 limit the extent of relative rotation between the mandrel 12 and the housing 24. In some embodiments, the opening 25 in the housing 24 through which the dual-block anchor 50 extends also limits the outward rotation of the dual-block anchor, such that the spring 15 remains compressed between the spring seat surfaces 64, 66. For example, the rear surface 53 of the drag block 14 may come into contact with one side of the opening 25 before the spring 15 is fully extended, and accordingly the spring remains in compression.

Other embodiments, such as those without a housing 24, may enable the spring 15 to be at rest, as shown in FIG. 11A, when the dual-block anchors 50 are in the free position. If the dual-block anchor 50 is rotated any further in the outward direction, the spring 15 is compressed between the spring seat surfaces 62, 68, and pushes the dual-block anchor toward the rest position shown in FIG. 11A. The size of each opening 25 in the housing 24, the distances between the spring seat surfaces 62, 64, 66, 68, and/or the dimensions of each spring 15 may be determined in accordance with a well bore size in order to ensure that that the drag blocks 14 remain in contact with the well bore, or at least protect the anchor blocks 16 from the well bore, when the dual-block anchors 50 are in an un-set position.

Figure 10D:
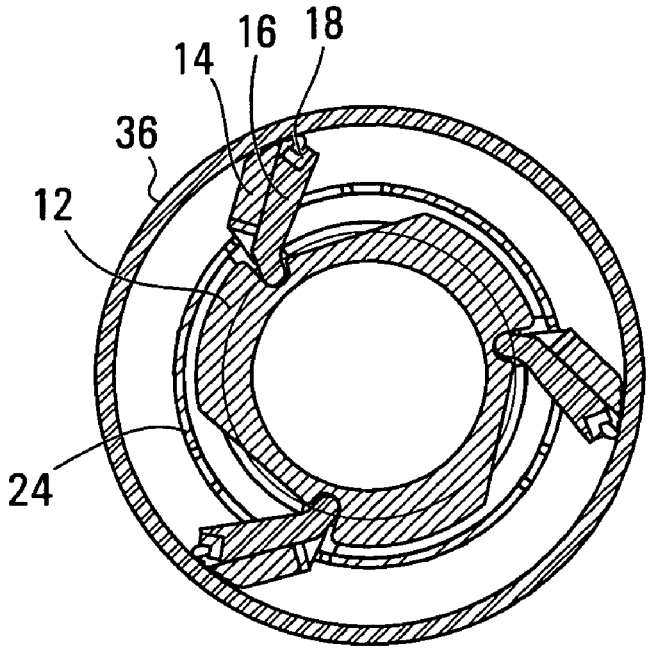
Figure 10D:
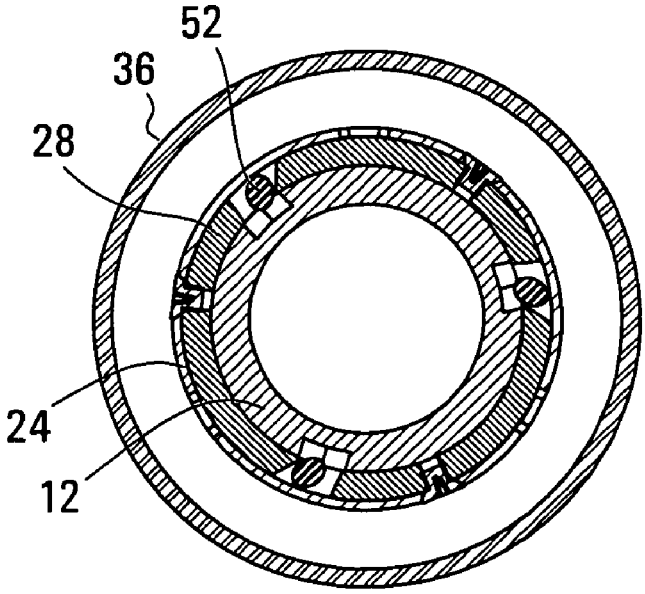

The run position of the dual-anchor blocks 50 is shown in FIG. 10D. In this position, when the anchor assembly 10 is being run in or out of a well, the dual-block anchors 50 maintain the anchor assembly 10 in an un-set state. With reference also to FIG. 6, it can be seen that in the run position, the spring 15 is compressed between the spring seat surface 64 of the drag block 14 and the opposing spring seat surface 66 of the anchor block 16. As noted above, this would tend to rotate the entire dual-block assembly outward, away from the mandrel 12. The compressed spring 15 biases the drag block 14 into contact with the well bore 36 and biases the anchor block 16 away from the well bore.

With the force exerted on the drag block 14 by the spring 15, and given the fact that movement of the drag block away from the mandrel 12 is constrained by the well bore 36, the drag block would effectively be pushing shoulders of the bearing slots 43, 45 in which the extensions 52 are received (and thus the housing 24) in a clockwise direction in FIG. 10D. The tapered shoulders of the bearing slots 43, 45 bias the drag block 14 toward the well bore 36. At the same time, the spring 15 causes the anchor block 16 to exert a force on the shoulder 58 of the mandrel 12 in the counter-clockwise direction, maintaining the anchor assembly 10 in the un-set position.

The drag block 14 is thus pushed outward by the spring 15 and kept in contact with the well bore 36, and both protects the anchor block 16 and prevents the anchor block from contacting the well bore. The anchor block 16 is biased away from the well bore 36, providing a further assurance of protection and prevention of contact with the well bore.

When the anchor assembly 10 is to be set, the drag block 14 and the housing 24 are stationary with the well bore 36, since the drag block is in contact with the well bore and stops the housing from rotating. Rotation of the mandrel 12 in a clockwise direction in FIG. 10D relative to the housing 24 pushes the structure 55, moving the anchor block 16 toward the set position shown in FIG. 11B. Since the drag block 14 is in contact with the well bore 36, the anchor block 16 rotates in the groove 40 of the mandrel 12 and extends beyond the drag block 14, until it contacts the well bore 36. The anchor assembly is now set. In the example shown in FIGS. 10D and 10E, the anchor block 16 rotates by about 5° between the run and set positions. In other embodiments, more, less, or substantially the same amount of rotation may be sufficient to set the anchor assembly.

Figure 10E:
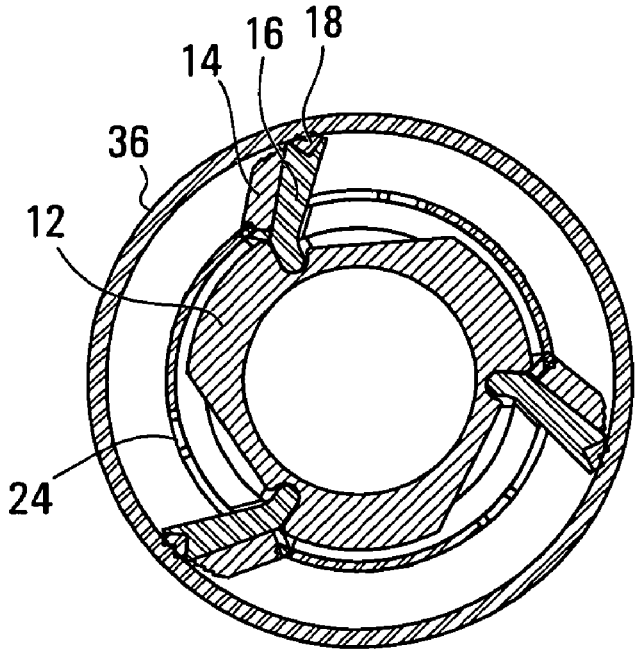
Figure 10E:
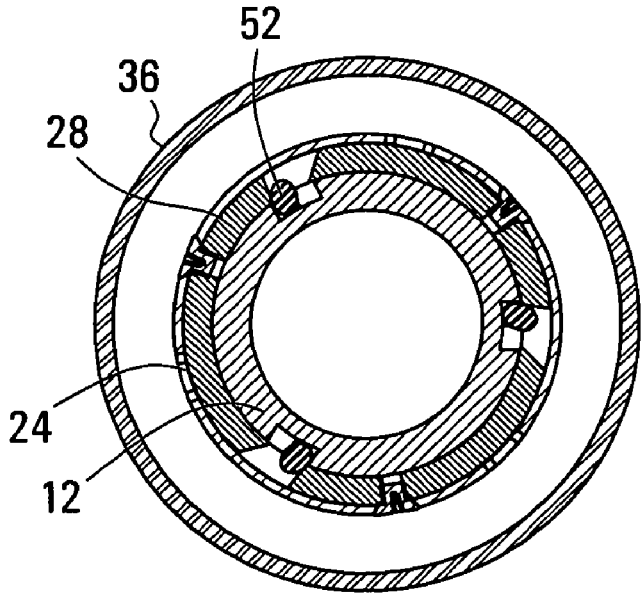

In addition to locating the anchor block 16 and providing a shoulder 58 for moving the anchor block from a run position to a set position, the groove 40 in the mandrel 12 may also limit the "back rotation" of the anchor block. As shown in FIG. 10E, the structure 55 of the anchor block 16 is seated in the groove 40 of the mandrel 12 and cannot be rotated further, since it is fully in contact with the shoulder 58.

Rotation between the housing 24 and the mandrel 12 can also be limited by the guide screw 32 and the housing slot 34, as noted above.

FIG. 10E also illustrates how the slots 42, 44 provide additional room to accommodate the extensions 52 of the drag blocks 14 when the dual-block anchors 50 are moved into the set position.

When the torque is released from the mandrel 12, the force exerted by the spring 15 on the spring seat surface 66 of the anchor block 16 will rotate the anchor block in a clockwise direction and push the mandrel shoulder 58 counter-clockwise. At the same time, the force exerted by the spring 15 on the spring seat surface 64 of the drag block 14 will push the bearing slots 43, 45 and thus the housing 24 in a clockwise direction, since rotation of the drag block is limited by the well bore 36. This automatically moves the anchor block 16 from its set position toward its run position, allowing the anchor assembly 10 to be moved in the well bore 36 or pulled to the surface.

Figure 12:
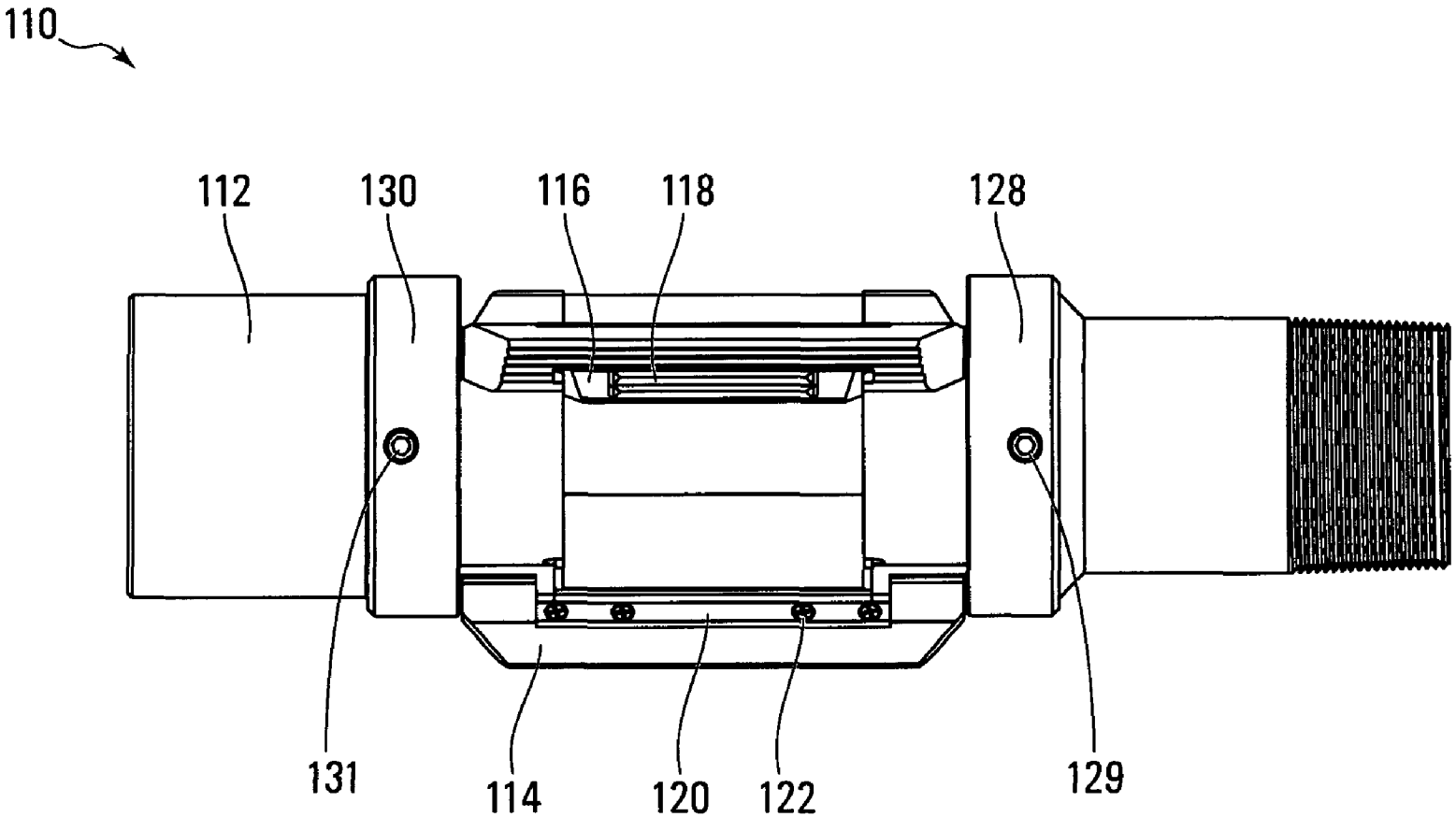
FIG. 12 is a side view of an example anchor assembly according to another embodiment of the invention.
Figure 13:
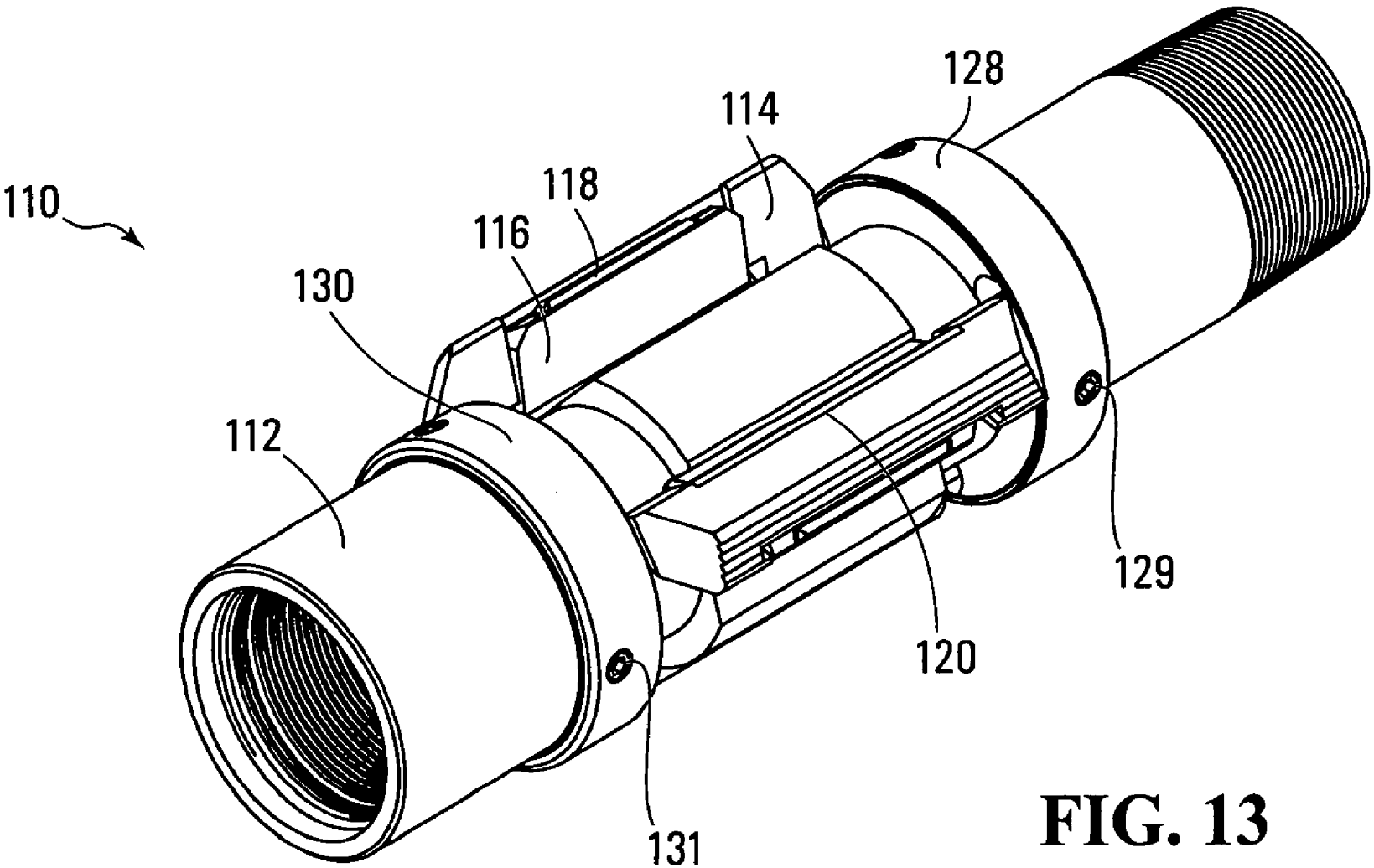
FIG. 13 is an isometric view of the example anchor assembly of FIG. 12.
Figure 14:
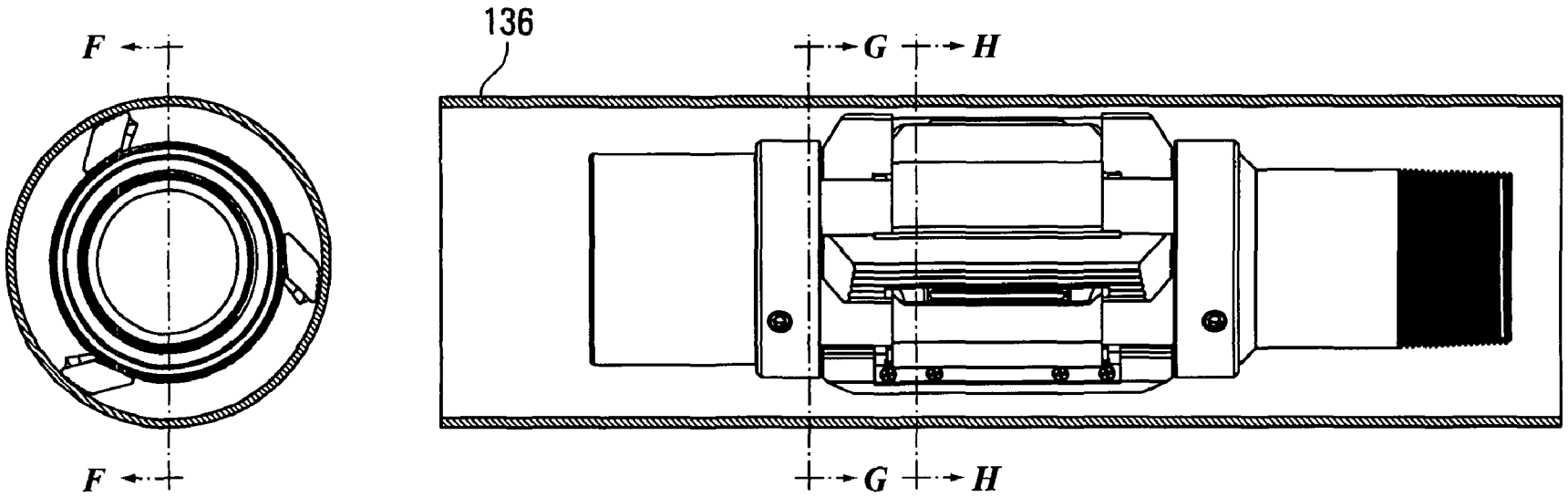
FIG. 14 includes end and side views of the example anchor assembly of FIG. 12 in a well bore.
Figure 15:
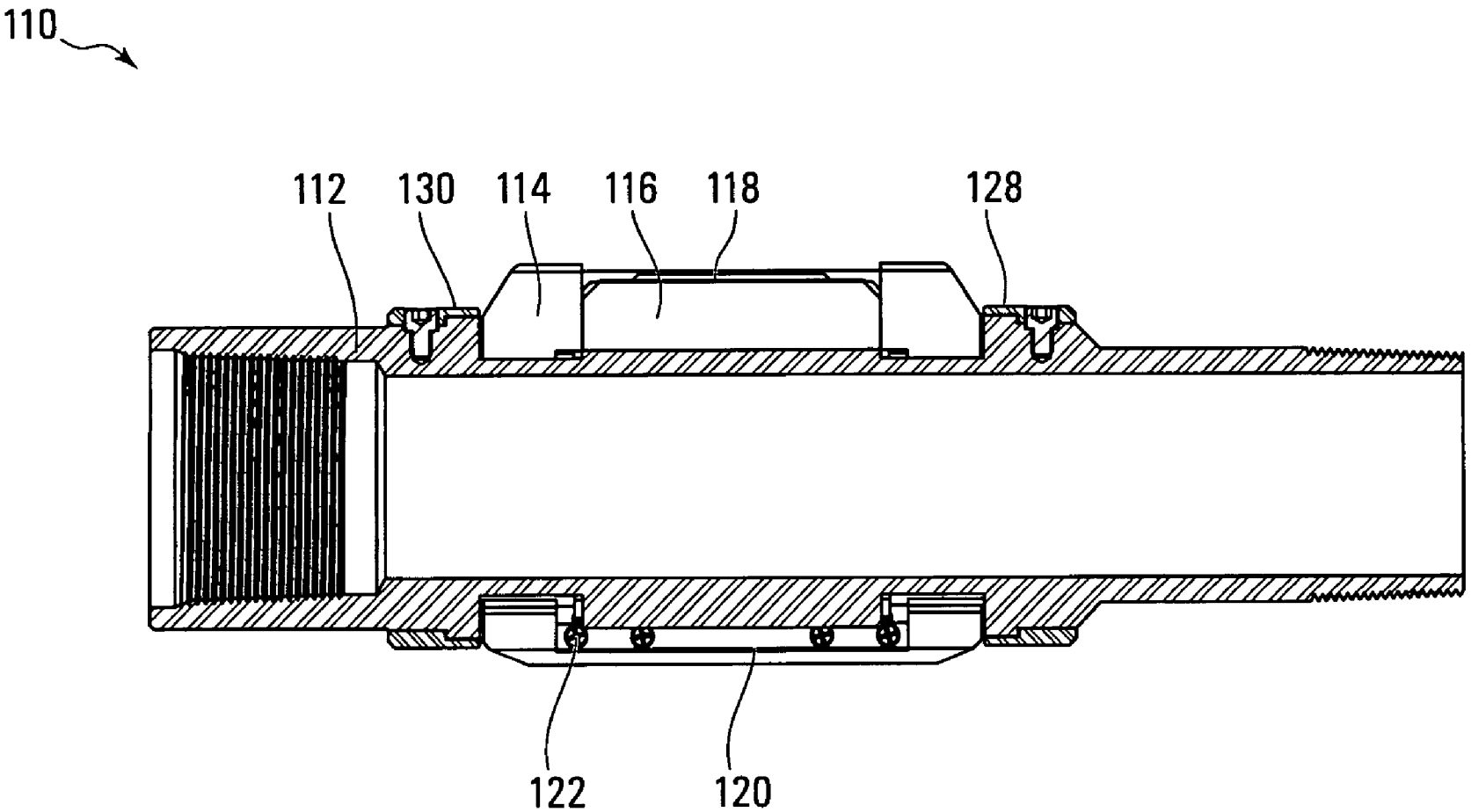
FIG. 15 is a cross-sectional view of the example anchor assembly of FIG. 12 along line F-F of FIG. 14.
Figure 16:
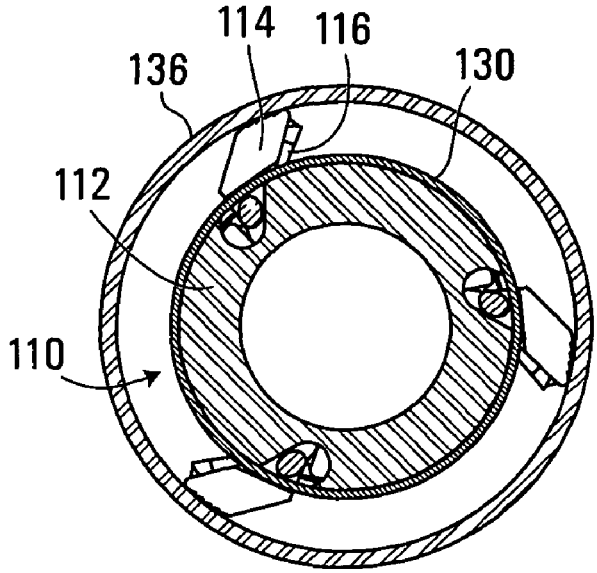
FIG. 16 is a cross-sectional view of the example anchor assembly of FIG. 12 along line G-G of FIG. 14.
Figure 17:
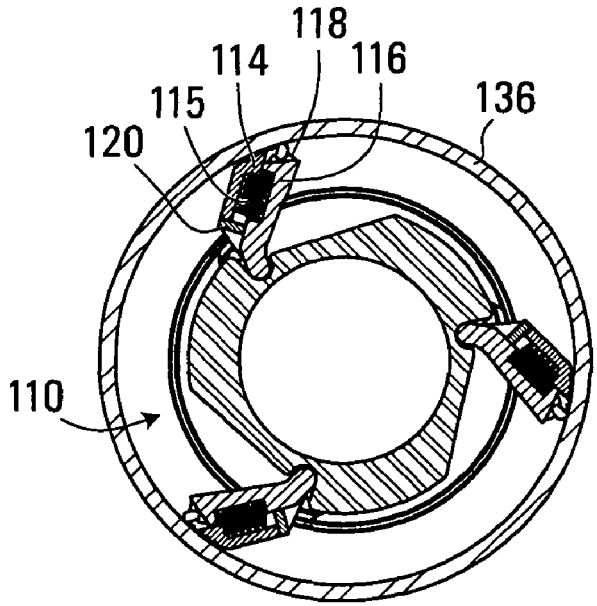
FIG. 17 is a cross-sectional view of the example anchor assembly of FIG. 12 along line H-H of FIG. 14.
Figure 18:
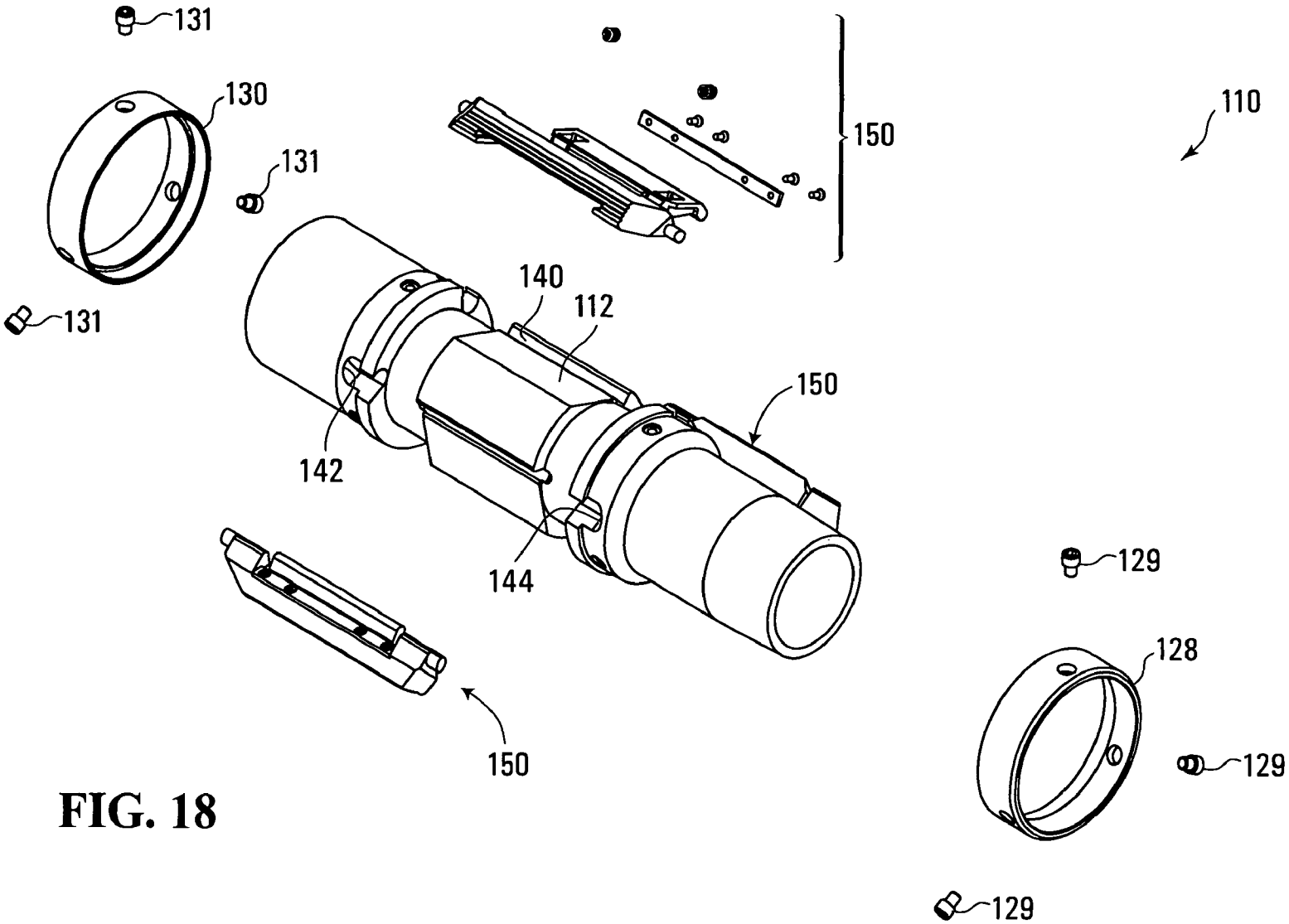
FIG. 18 is an exploded view of the example anchor assembly of FIG. 12.
Figure 19A:
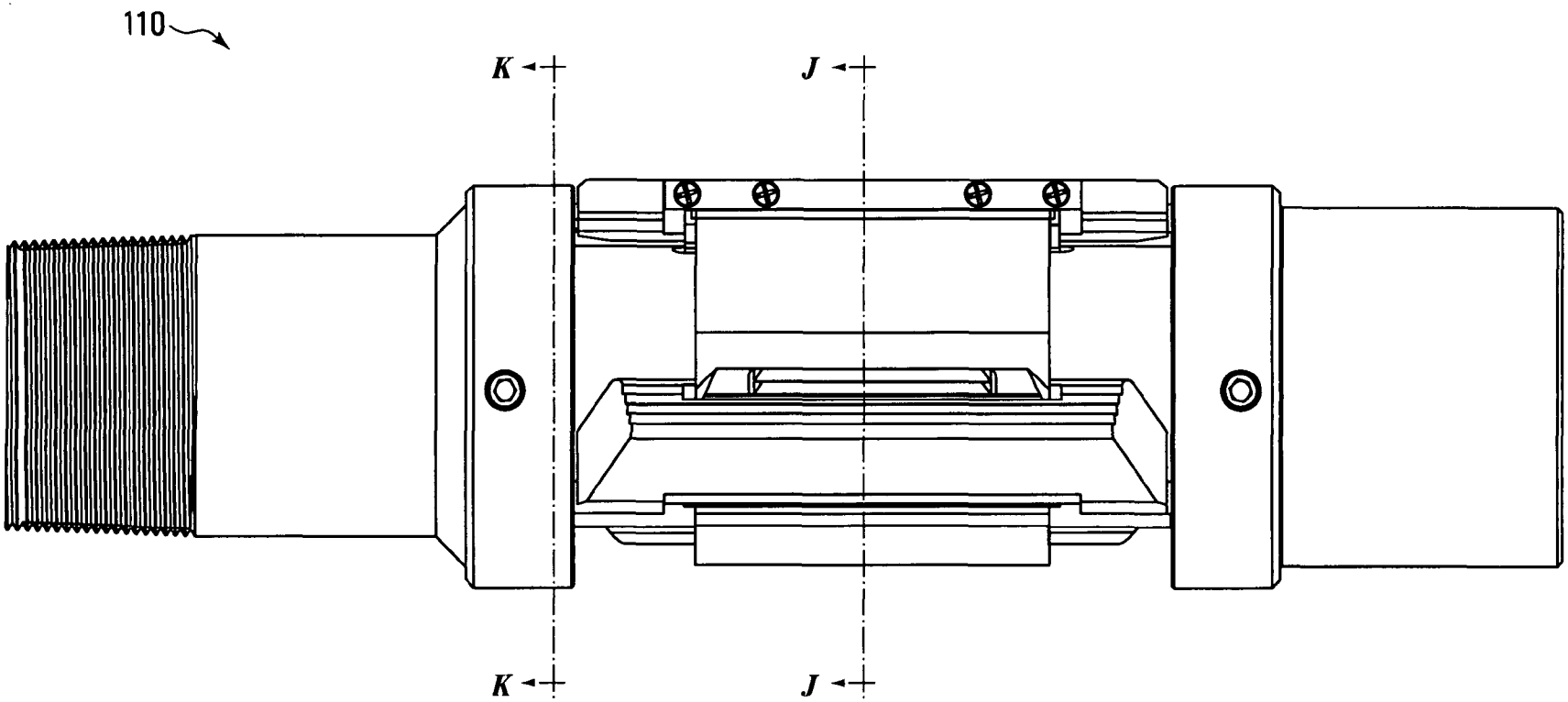
FIG. 19A is a side view of the example anchor assembly of FIG. 12.
Figure 19B:
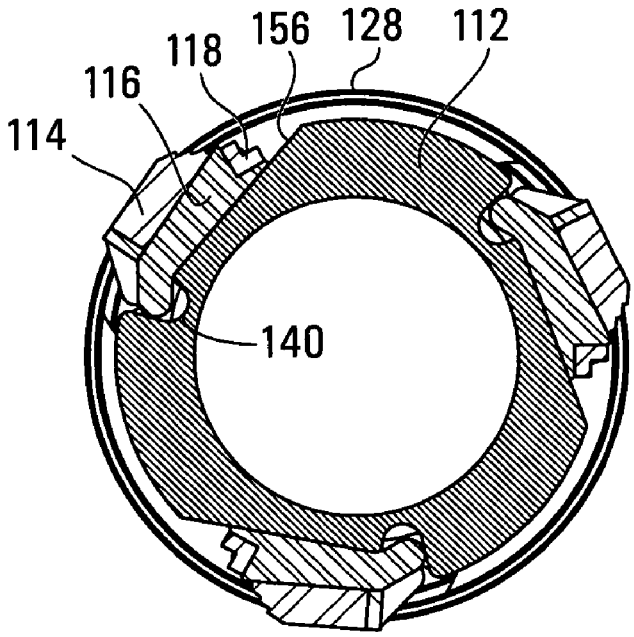
FIGS. 19B through 19E include cross-sectional views of the example anchor assembly of FIG. 12 along lines J-J and K-K of FIG. 19A, for different positions of the dual-block anchors.
Figure 19B:
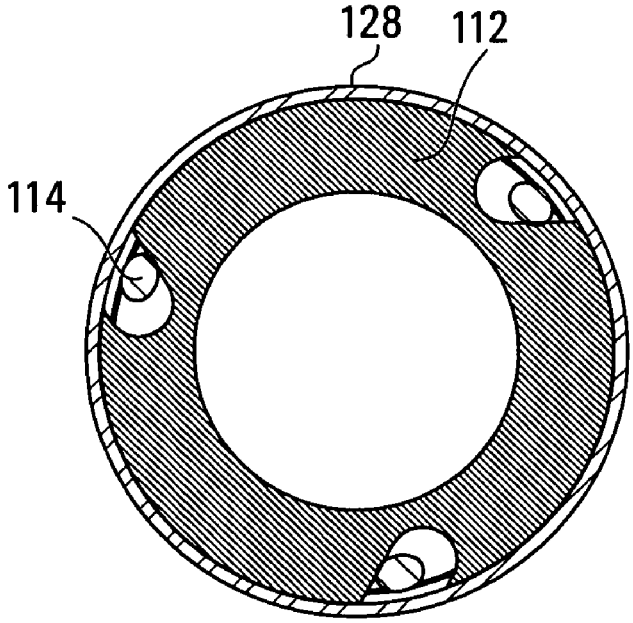
Figure 19C:
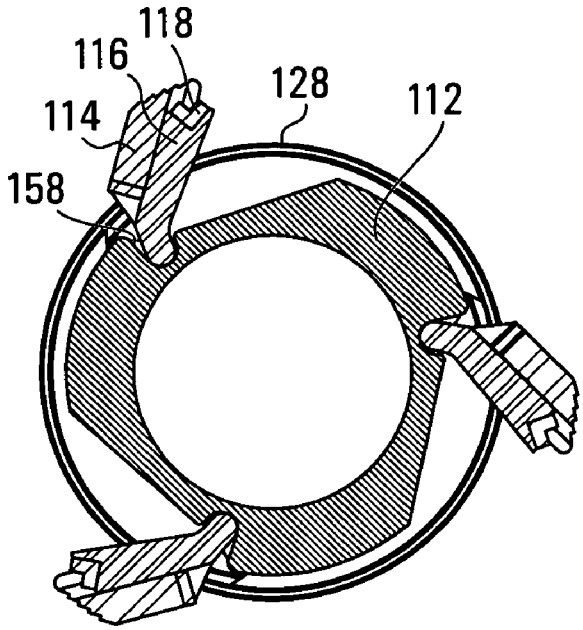
Figure 19C:
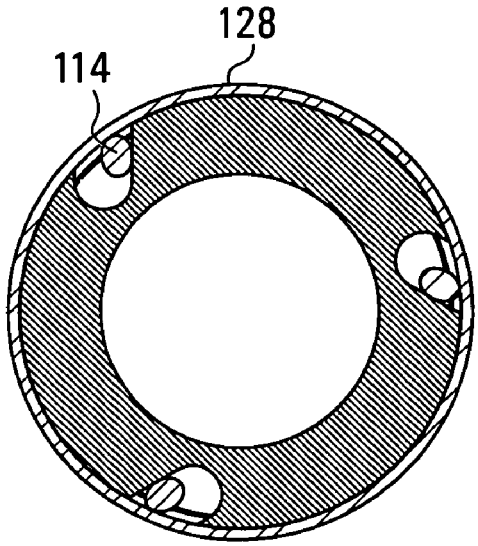
Figure 19D:
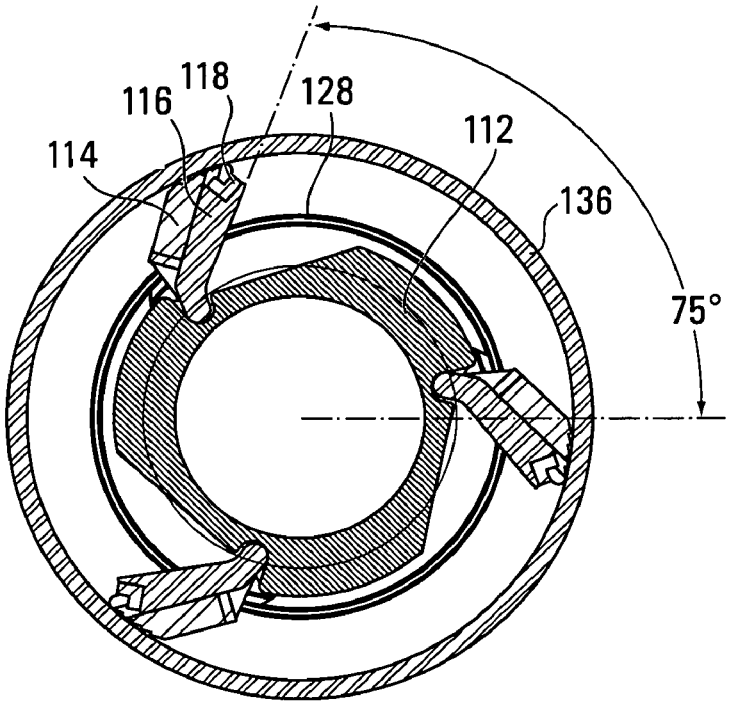
Figure 19D:
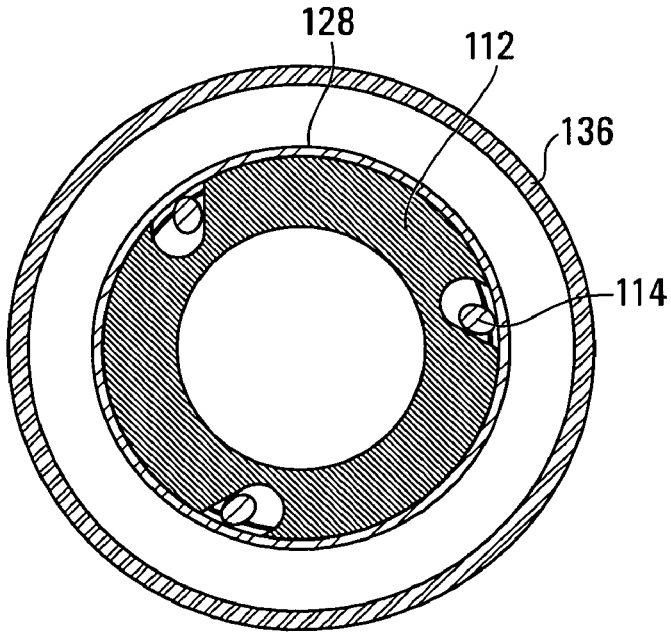
Figure 19E:
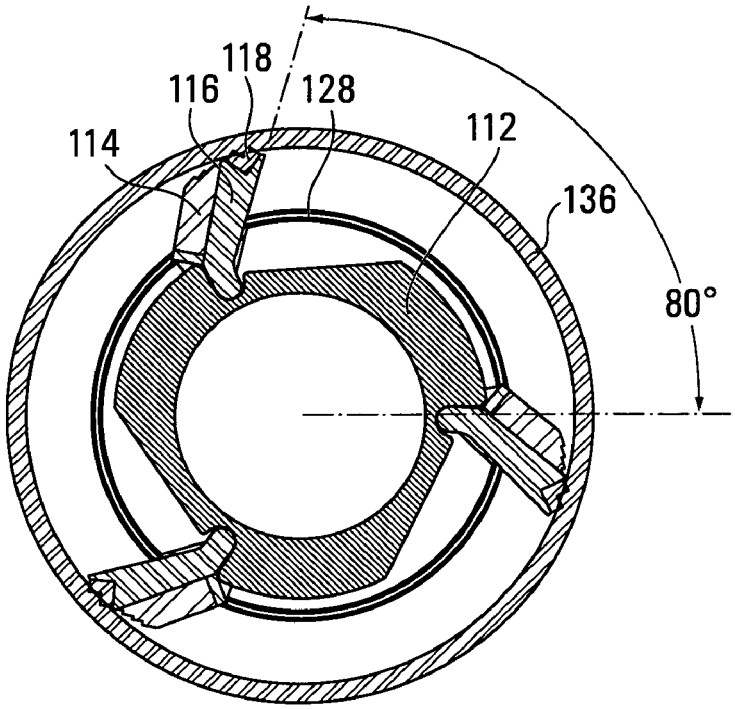
Figure 19E:
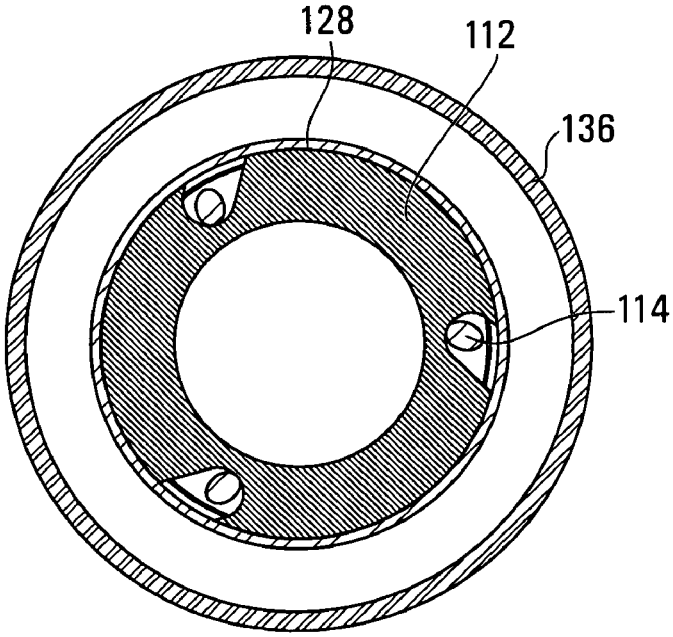

An example anchor assembly according to another embodiment of the invention is shown in FIGS. 12 to 19E. FIG. 12 is a side view, FIG. 13 is an isometric view, FIG. 14 includes end and side views of the example anchor assembly of FIG. 12 in a well bore, FIGS. 15 to 17 are respective cross-sectional views of the example anchor assembly of FIG. 12 along lines F-F, G-G, H-H of FIG. 14, FIG. 18 is an exploded view, FIG. 19A is a side view, and FIGS. 19B through 19E include cross-sectional views along lines J-J and K-K of FIG. 19A, for different positions of the dual-block anchors.

In the example anchor assembly 110, which is a multi set assembly without a housing, there are no bearings and the housing and bearings have been replaced with two retaining rings 128, 130. The slots and shoulders in the bearings 30, 28 of the anchor assembly 10 have been replaced with slots 142, 144 in the mandrel 112, under the retaining rings 130, 128. Thus, the anchor assembly 110 represents one example of an implementation in which extensions of drag blocks 114 are accommodated by slots in the mandrel 112.

As shown, the example anchor assembly 110 includes a drag block 114, an anchor block 116, and a mandrel 112 which would be coupled to a tubing string. An insert 118, illustratively a carbide insert, may be provided in the anchor block 116 in some embodiments for contacting a well bore 136 when the anchor block is in its set position. A spring retaining plate 120 is attached to the drag block 114 using fasteners 122, and retains springs 115 between the drag block 114 and the anchor block 116.

The retaining rings 128, 130 are attached to the mandrel 112 using fasteners 129, 131 such as screws. The retaining rings retain the dual-block anchors 150 on the mandrel 112 by retaining extensions of the drag block 114 in slots 142, 144 in the mandrel 112. The mandrel 112, as in the first embodiment described above, includes a groove 140 which locates the anchor block 116 and provides a shoulder 158 for moving the anchor block into contact with the well bore 136.

The dual-block anchors 150 may be the same as the dual-block anchors 50 described above. The function of the example anchor assembly 110 is also substantially the same as the anchor assembly 10, except that the drag block 114 bears on the mandrel slots 142, 144, and that when torque is released from the mandrel 112, the drag block will push against the well bore 136, and the anchor block 116 will push against the mandrel 112 to un-set the anchor assembly. Otherwise, operation of the anchor assembly 110 may be as described above, and is illustrated in FIGS. 19B to 19E, which respectively show a collapsed position of the dual-block anchors 150 on the surface 156 of the mandrel 112, the free position of the anchors, a run position of the anchors, and a set position of the anchors.

Figure 20:
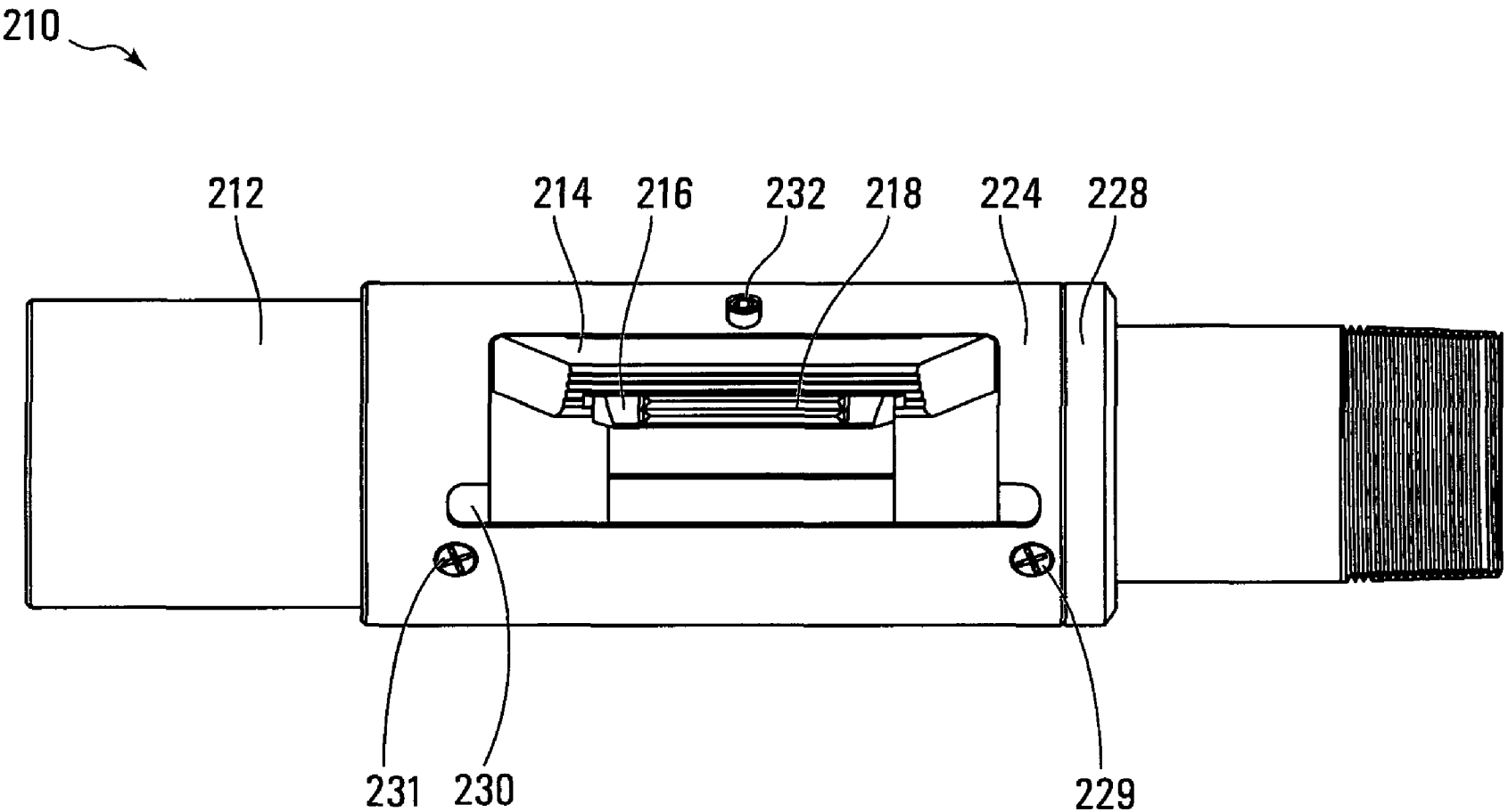
FIG. 20 is a side view of an example anchor assembly according to a further embodiment of the invention.
Figure 21:
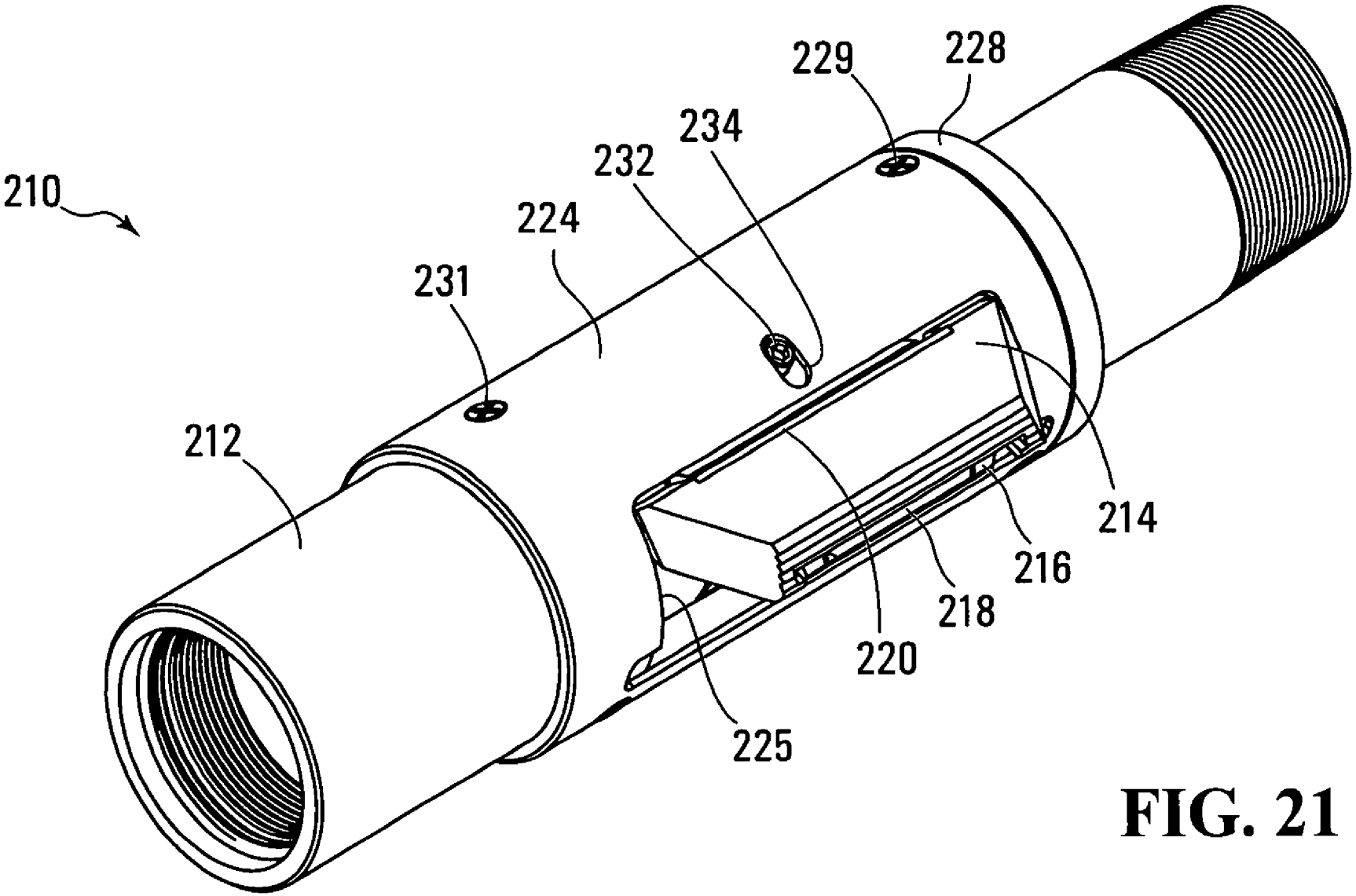
FIG. 21 is an isometric view of the example anchor assembly of FIG. 20.
Figure 22:
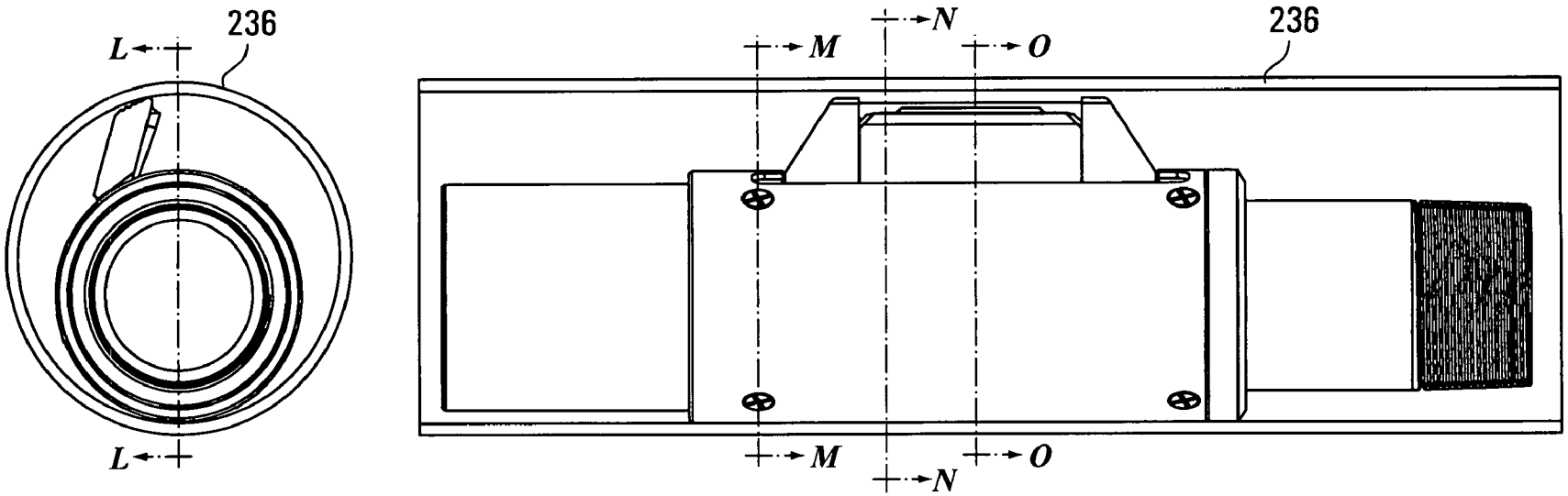
FIG. 22 includes end and side views of the example anchor assembly of FIG. 20 in a well bore.
Figure 23:
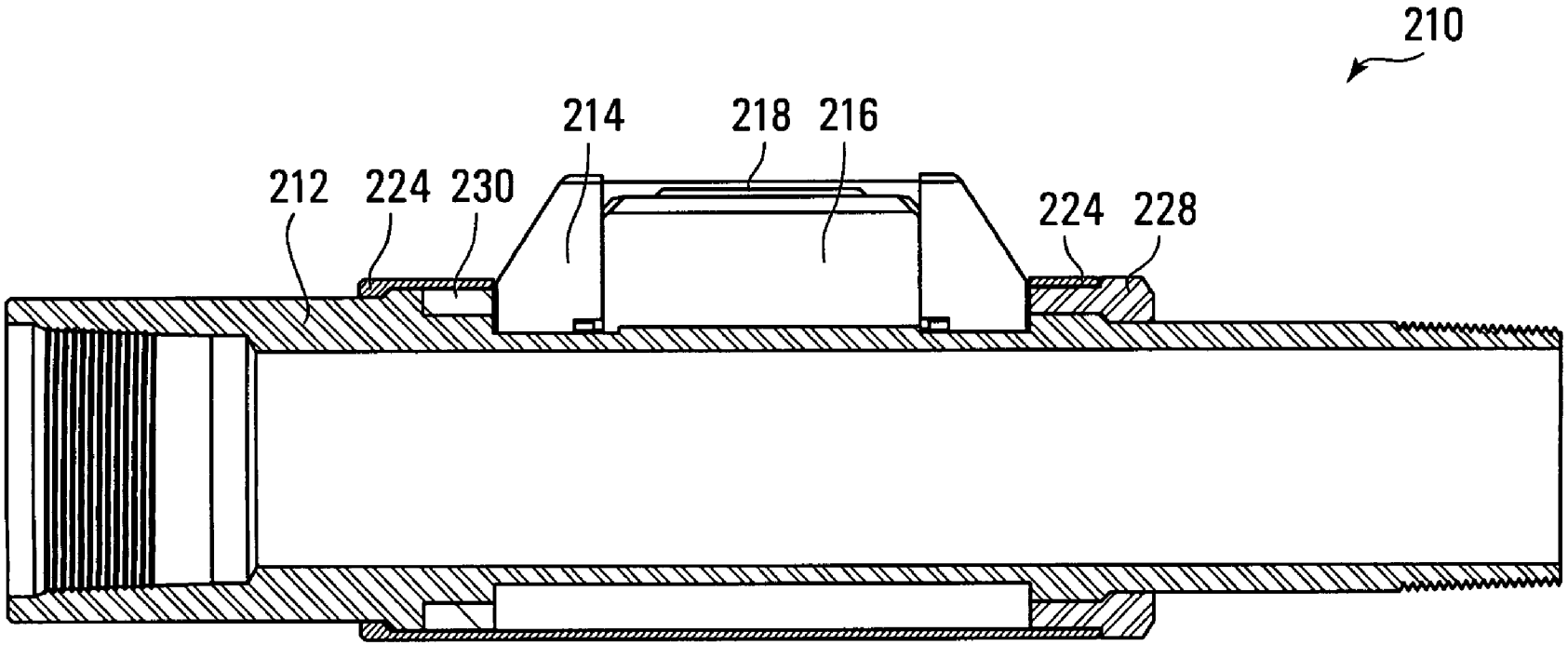
FIG. 23 is a cross-sectional view of the example anchor assembly of FIG. 20 along line L-L of FIG. 22.
Figure 26:
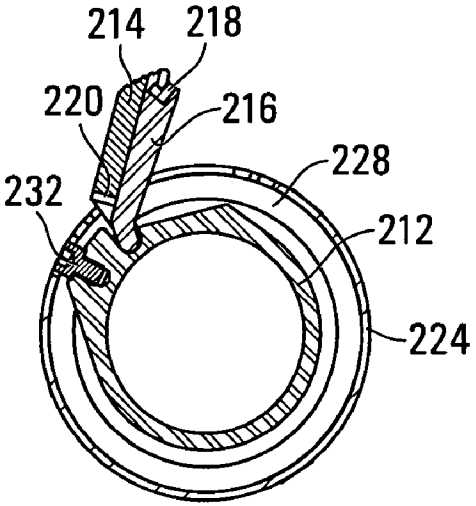
FIG. 26 is a cross-sectional view of the example anchor assembly of FIG. 20 along line O-O of FIG. 22.
Figure 25:
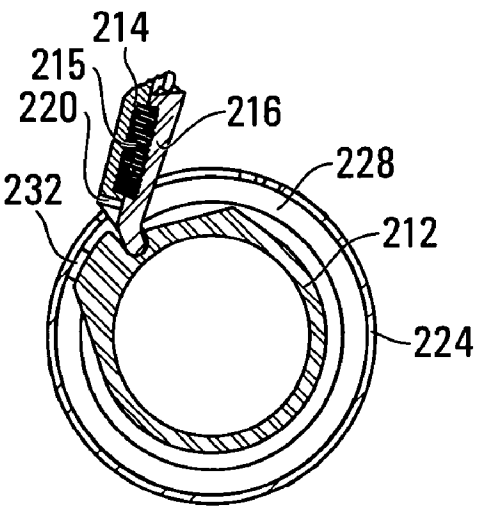
FIG. 25 is a cross-sectional view of the example anchor assembly of FIG. 20 along line N-N of FIG. 22.
Figure 24:
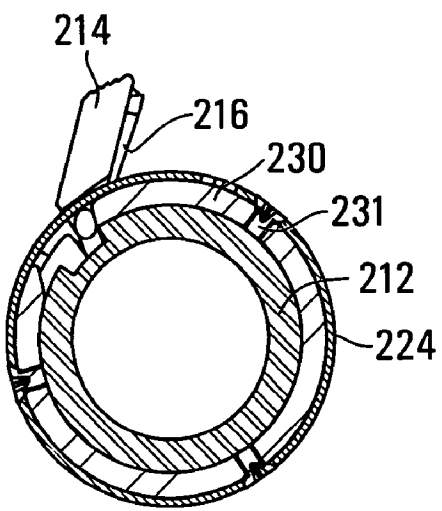
FIG. 24 is a cross-sectional view of the example anchor assembly of FIG. 20 along line M-M of FIG. 22.
Figure 27:
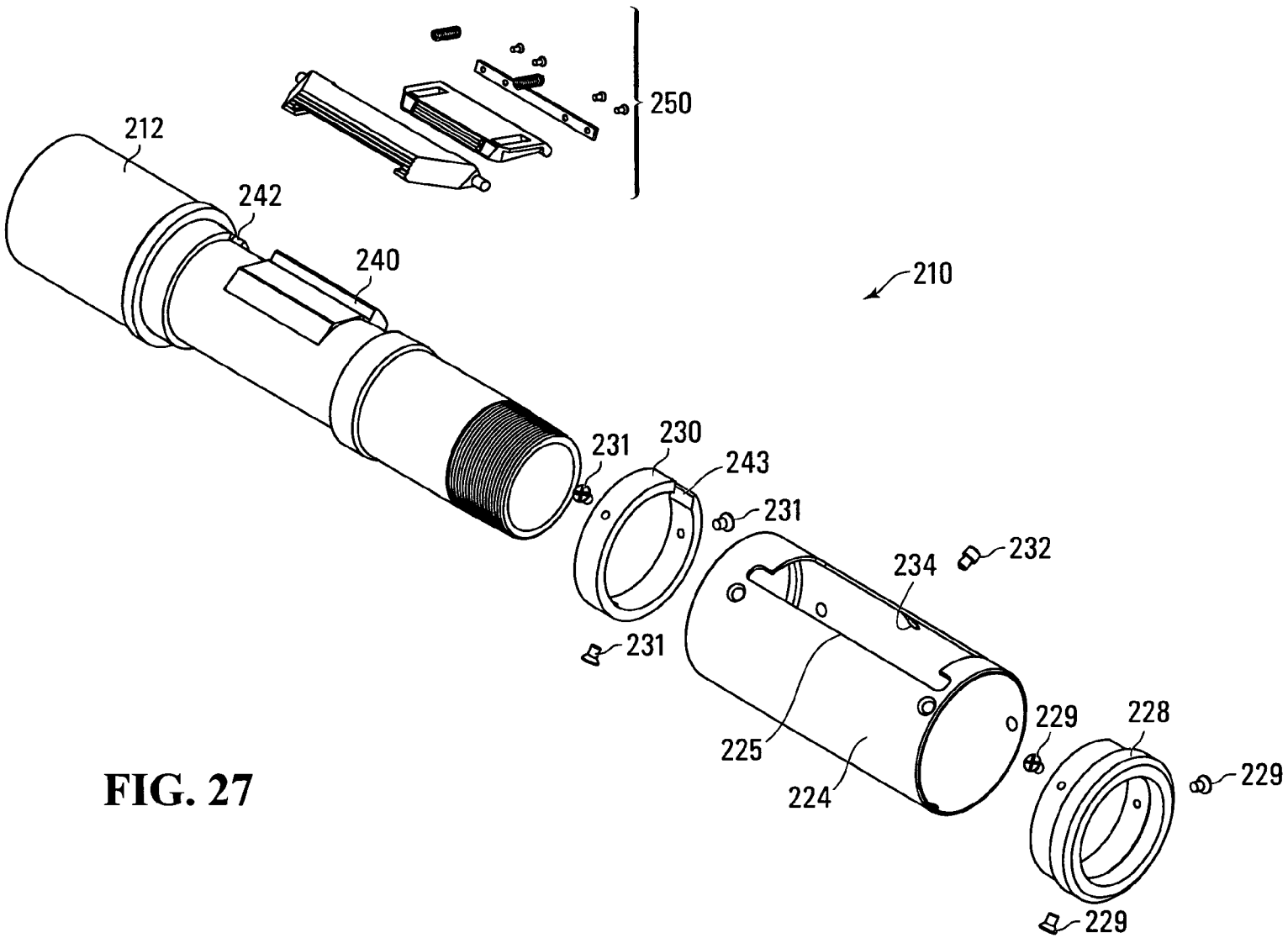
FIG. 27 is an exploded view of the example anchor assembly of FIG. 20.
Figure 28A:
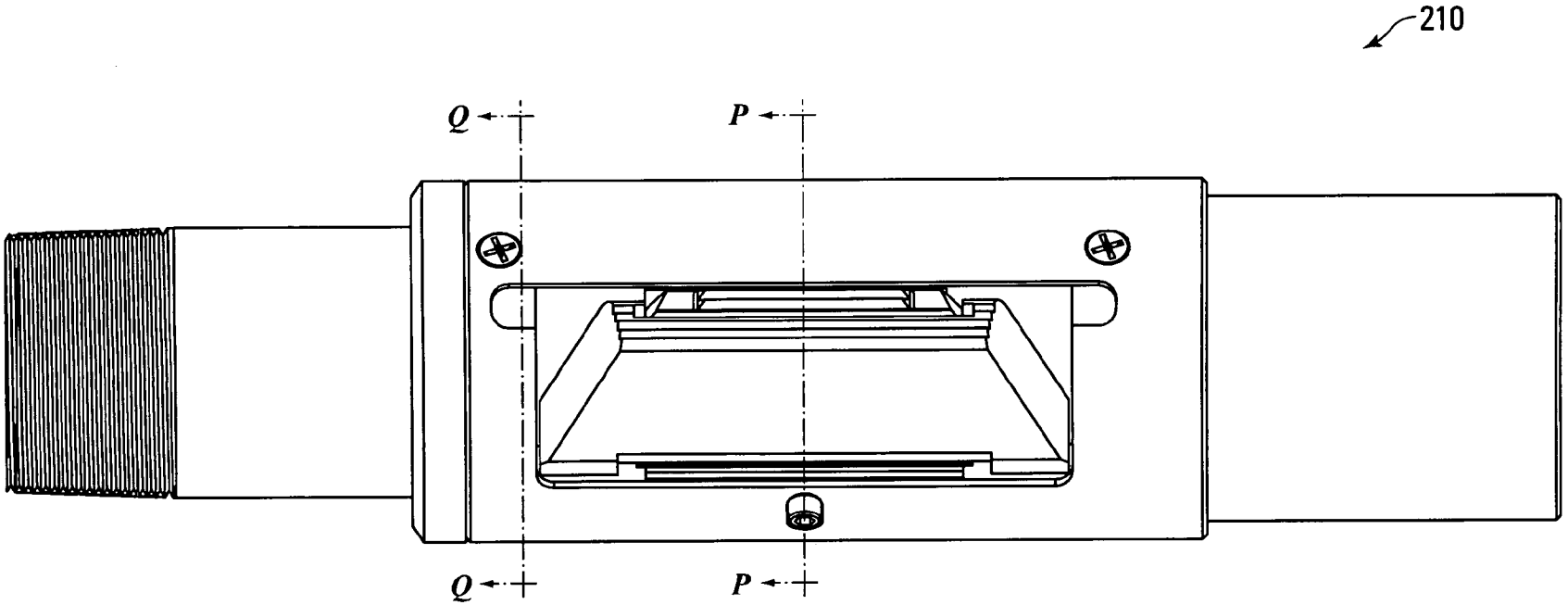
FIG. 28A is a side view of the example anchor assembly of FIG. 20.
Figure 28B:
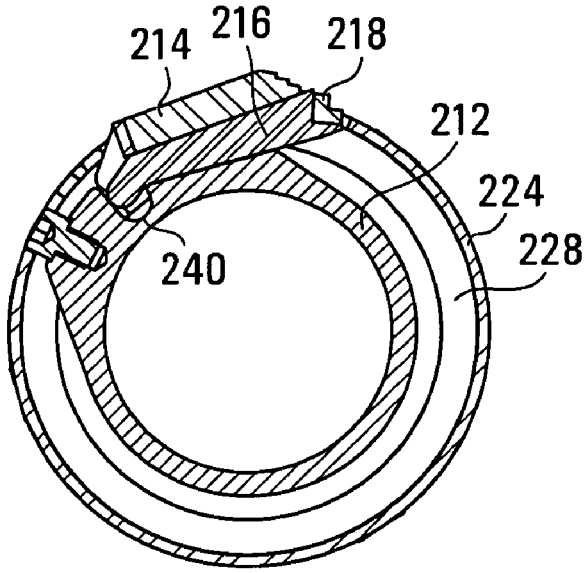
FIGS. 28B through 28E include cross-sectional views of the example anchor assembly of FIG. 20 along lines P-P and Q-Q of FIG. 28A, for different positions of the dual-block anchors.
Figure 28B:
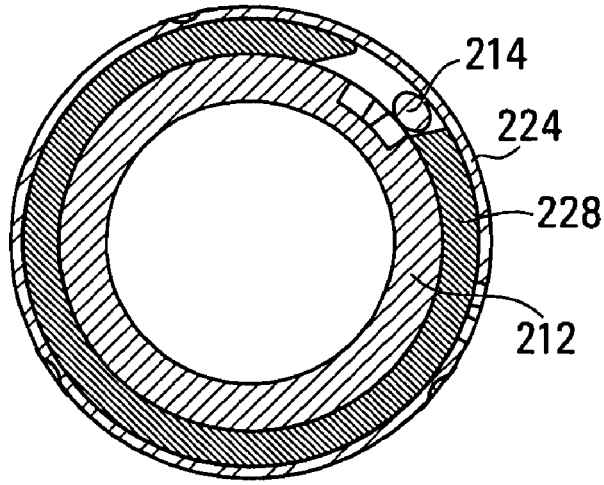
Figure 28C:
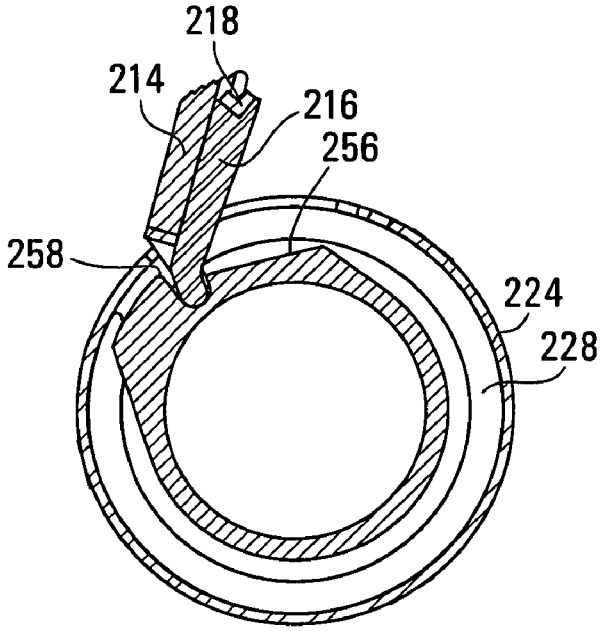
Figure 28C:
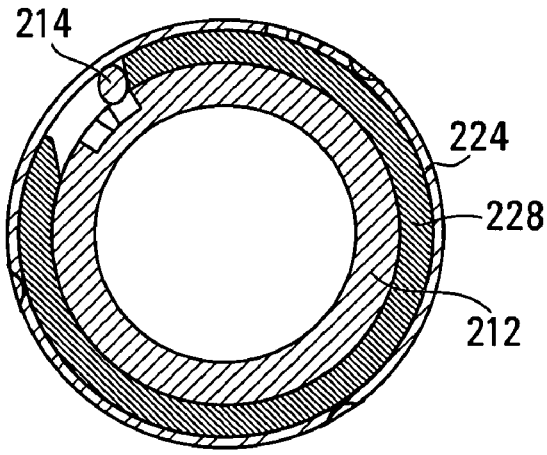
Figure 28D:
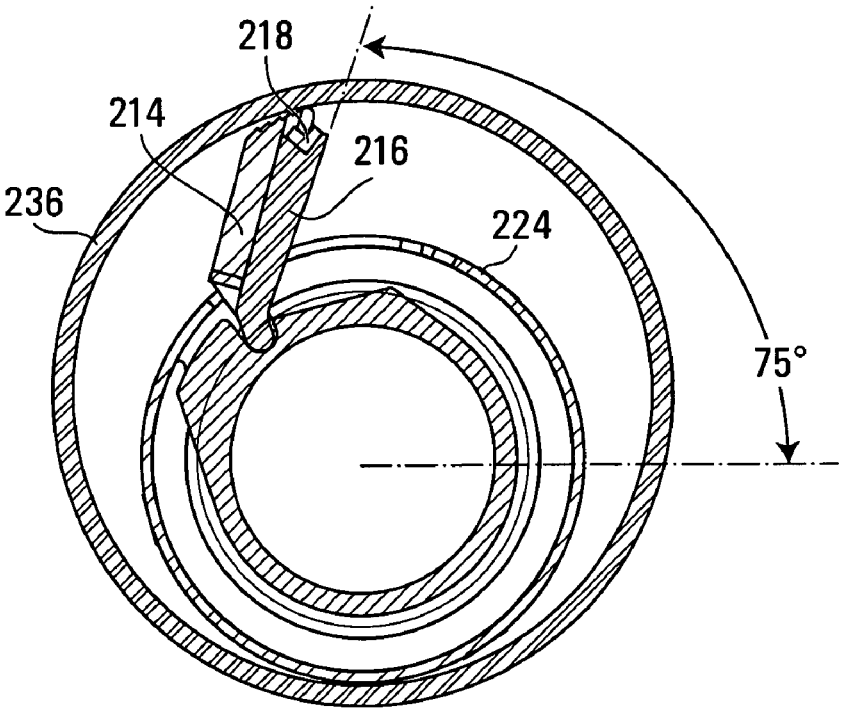
Figure 28D:
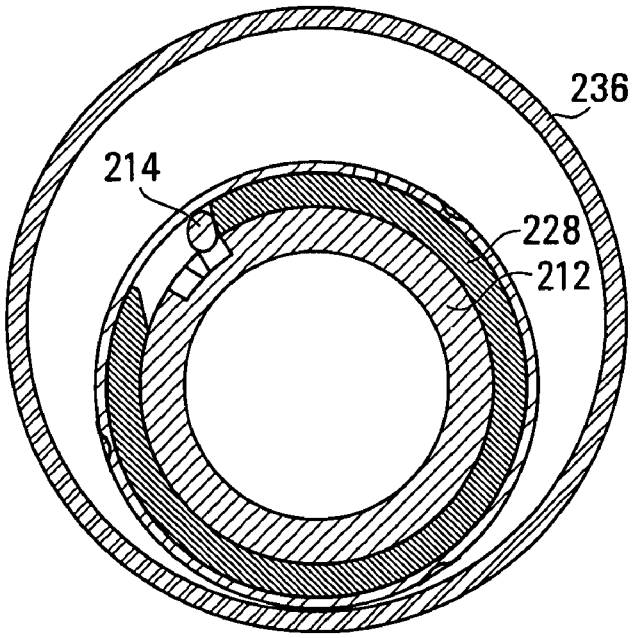
Figure 28E:
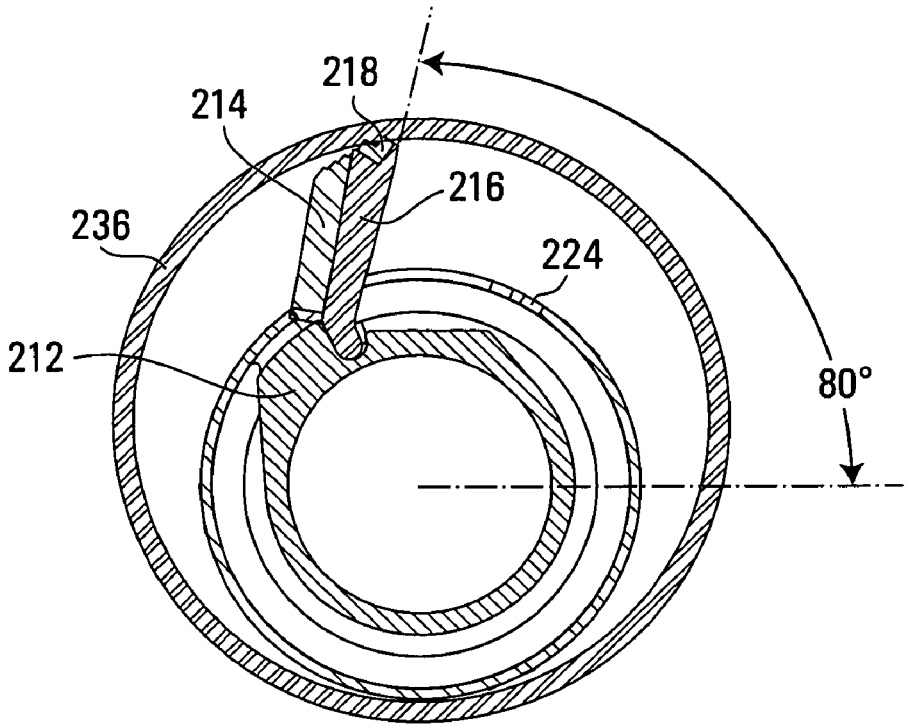
Figure 28E:
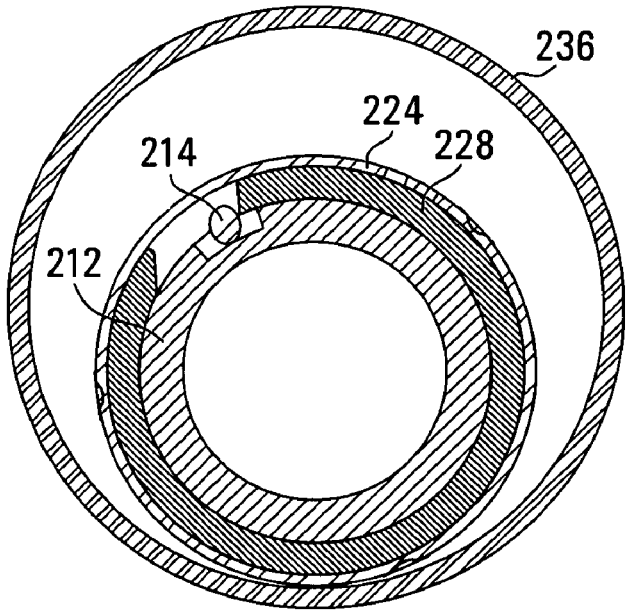

As noted above, embodiments of the invention having only a single anchor are also contemplated. An example anchor assembly 210 according to one such embodiment is shown in FIGS. 20 to 28E. FIG. 20 is a side view, FIG. 21 is an isometric view, FIG. 22 includes end and side views of the example anchor assembly 210 in a well bore, FIGS. 23 to 26 are respective cross-sectional views of the example anchor assembly 210 along lines L-L, M-M, N-N, O-O of FIG. 22, FIG. 27 is an exploded view, FIG. 28A is a side view, and FIGS. 28B through 28E include cross-sectional views along lines P-P and Q-Q of FIG. 28A, for different positions of the dual-block anchor.

The example anchor assembly 210 includes a drag block 214, an anchor block 216 with an insert 218, and a mandrel 212 which would be coupled to a tubing string. Bearings 228, 230 are located between a housing 224 and the mandrel 212, and are attached to the housing with fasteners 229, 231, illustratively screws. As described above for the example multi set assembly 10, the housing 224 includes an opening 225 through which the dual-block anchor 250 extends, and the housing and the bearings 228, 230 enable relative rotation between the mandrel 212 and the housing and also retain the dual-block anchor 250. The extent of rotation between the housing 224 and the mandrel 212 is limited by the guide screw 232 and the slot 234 in the housing. The mandrel 212, as in the first embodiment described above, includes a groove 240 which locates the anchor block 216 and provides a shoulder 258 for moving the anchor block into contact with the well bore 236, and slots, one of which is shown at 242 in FIG. 27, for receiving extensions of the drag block 214. The bearings 228, 230 also include slots for receiving the drag block extensions, and one of those slots is shown at 243 in FIG. 27.

The dual-block anchor 250 may be the same as the dual-block anchors 50 described above. The function of the example anchor assembly 210 is also substantially the same as the anchor assembly 10, with the exception that only a single dual-block anchor is provided. In the example single set anchor assembly 210, the housing 224 rests against the well bore 236, while the mandrel 212 is pushing the anchor block 216 into its set position. The housing 224 is then in stationary contact with the well bore 236 when the anchor assembly 210 is set, and will prevent wear of the well bore caused by vibrations and oscillations of the mandrel 212.

Operation of the anchor assembly 210 may otherwise be as described above, as will be apparent from FIGS. 28B to 28E, which show a collapsed position of the dual-block anchor 250 on the surface 256 of the mandrel 212, a free position of the anchor, a run position of the anchor, and a set position of the anchor.

The physical dimensions of the anchor 250 may be different than in multi set embodiments. For example, since only one anchor is provided in the single set case, longer drag and anchor blocks may be used to ensure proper contact with the well bore 236.

Figure 29:
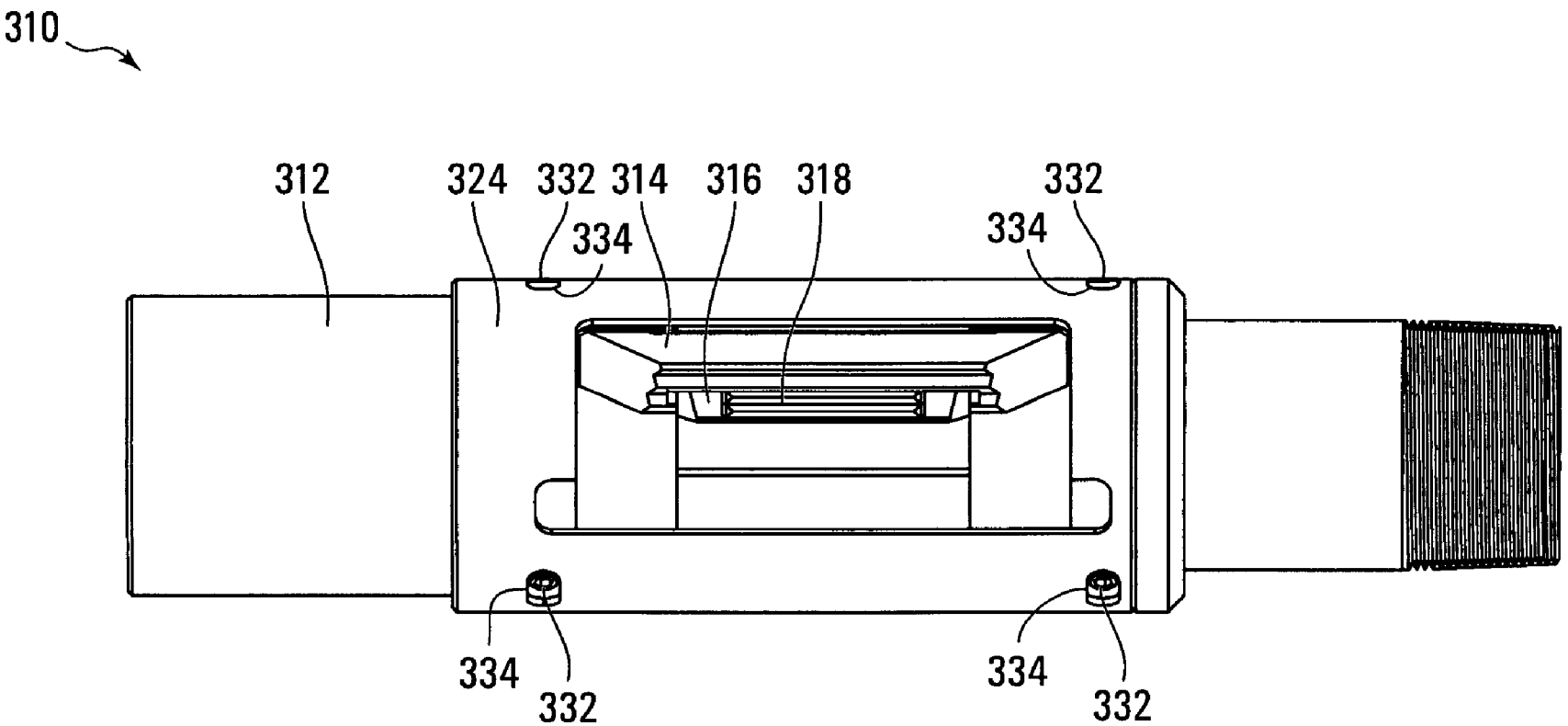
FIG. 29 is a side view of an example anchor assembly according to yet another embodiment of the invention.
Figure 30:
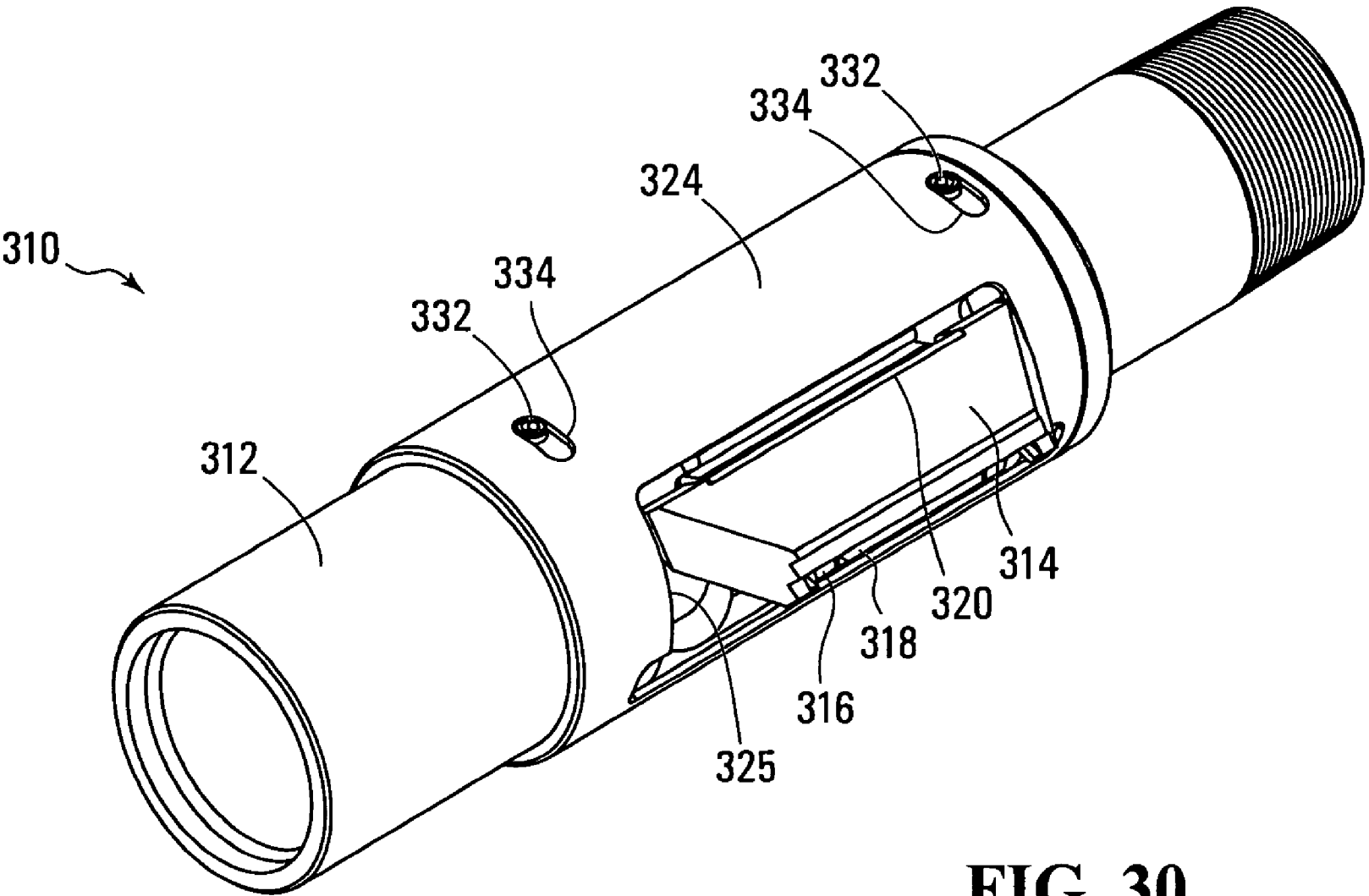
FIG. 30 is an isometric view of the example anchor assembly of FIG. 29.
Figure 31:
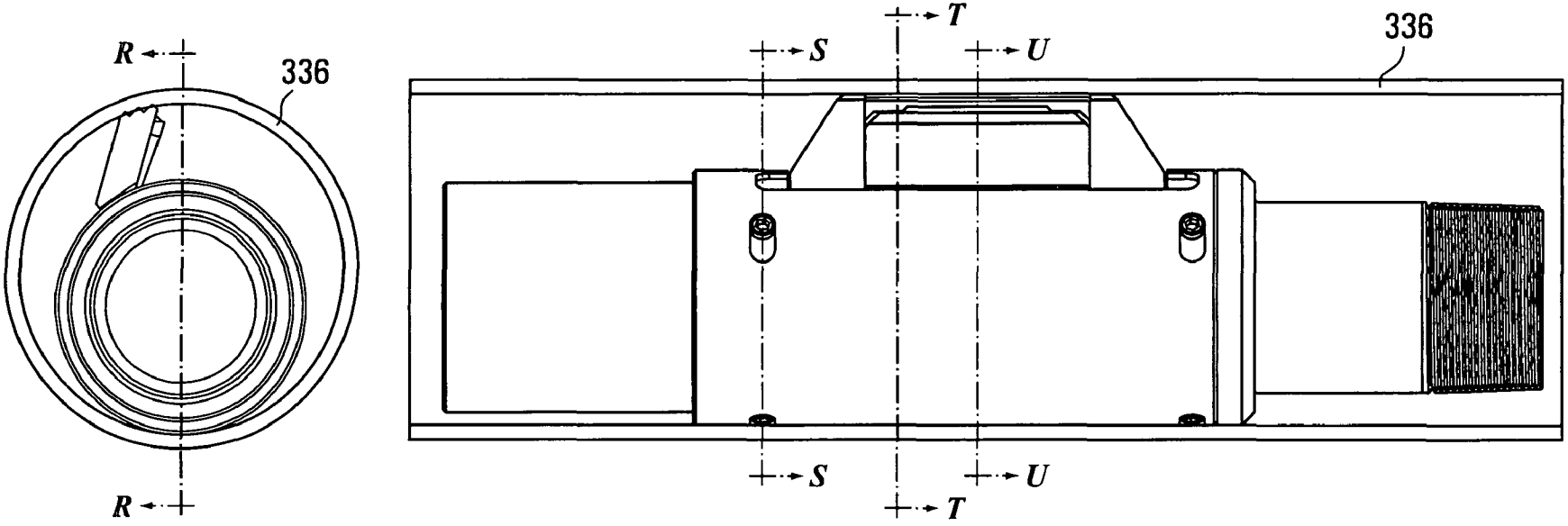
FIG. 31 includes end and side views of the example anchor assembly of FIG. 29 in a well bore.
Figure 32:
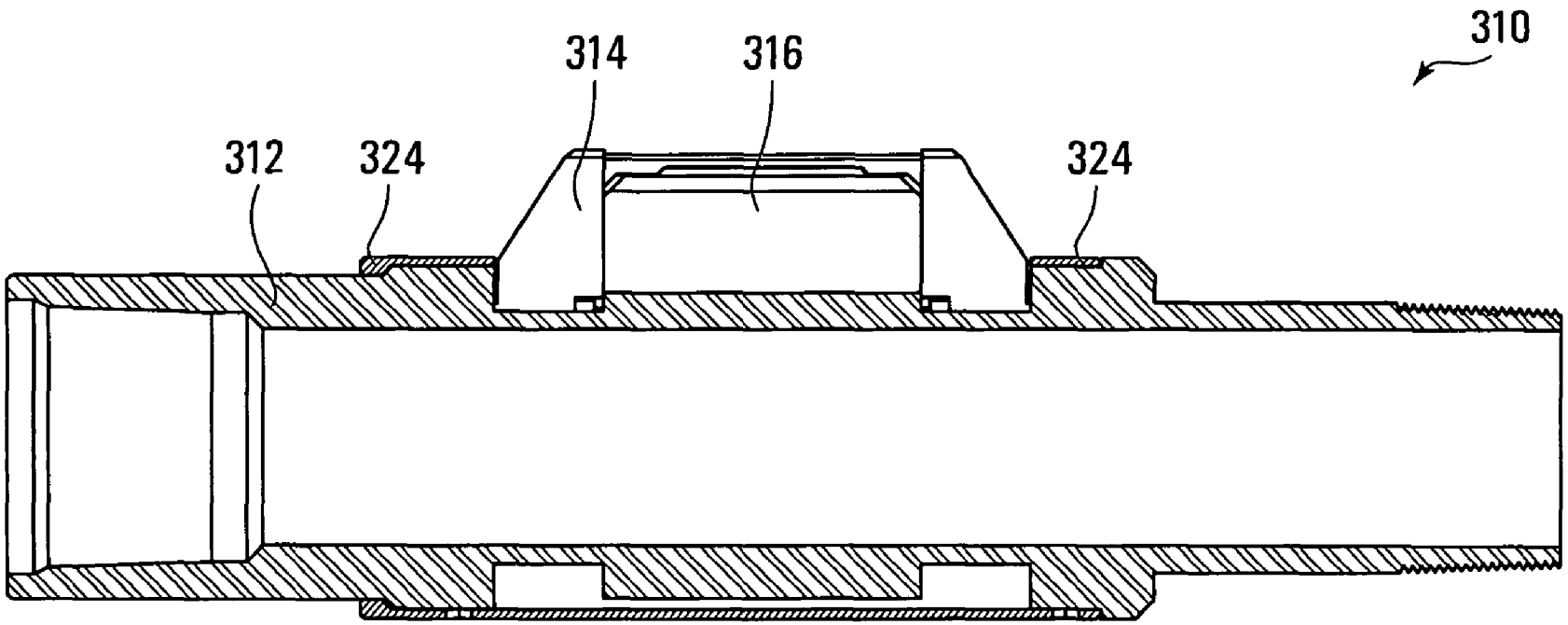
FIG. 32 is a cross-sectional view of the example anchor assembly of FIG. 29 along line R-R of FIG. 31.
Figure 35:
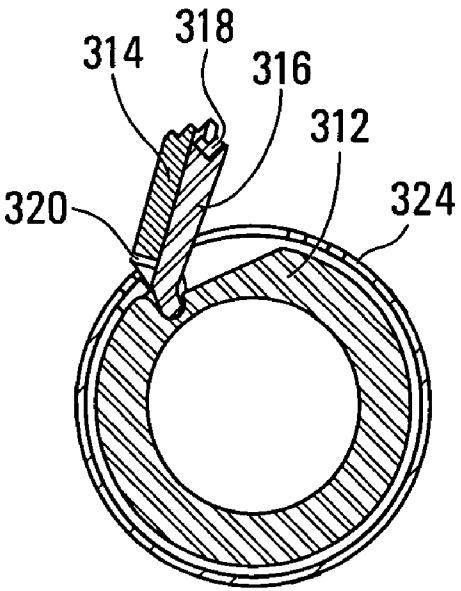
FIG. 35 is a cross-sectional view of the example anchor assembly of FIG. 29 along line U-U of FIG. 31.
Figure 34:
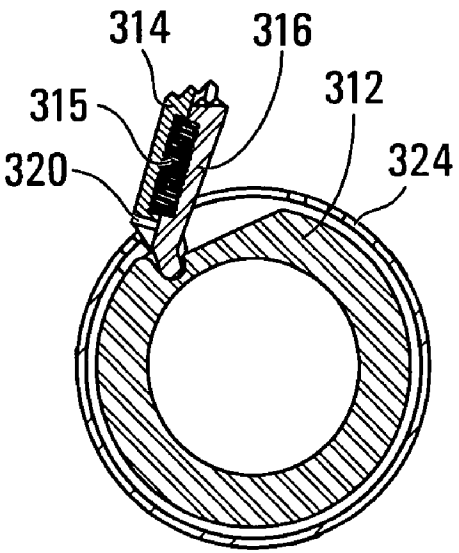
FIG. 34 is a cross-sectional view of the example anchor assembly of FIG. 29 along line T-T of FIG. 31.
Figure 33:
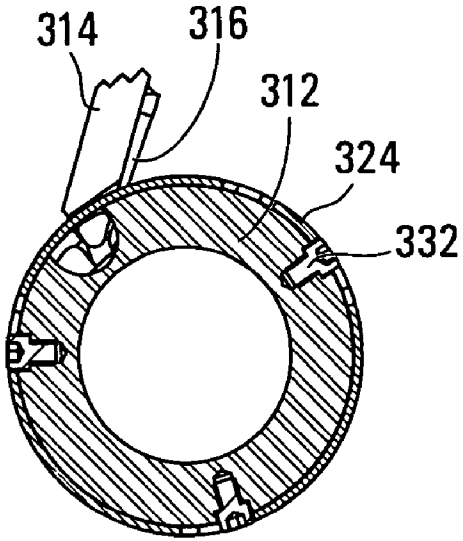
FIG. 33 is a cross-sectional view of the example anchor assembly of FIG. 29 along line S-S of FIG. 31.
Figure 36:
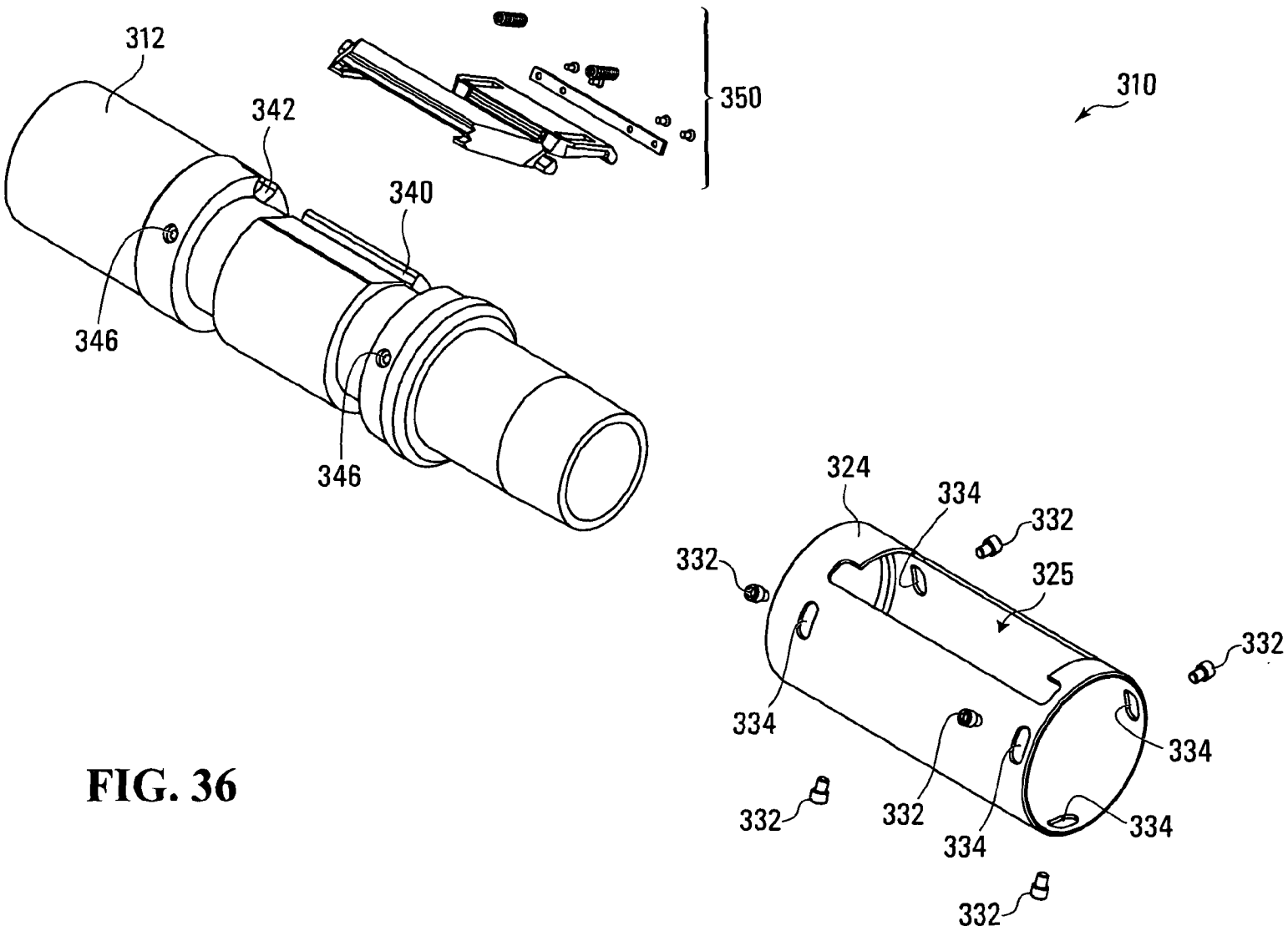
FIG. 36 is an exploded view of the example anchor assembly of FIG. 29.
Figure 37A:
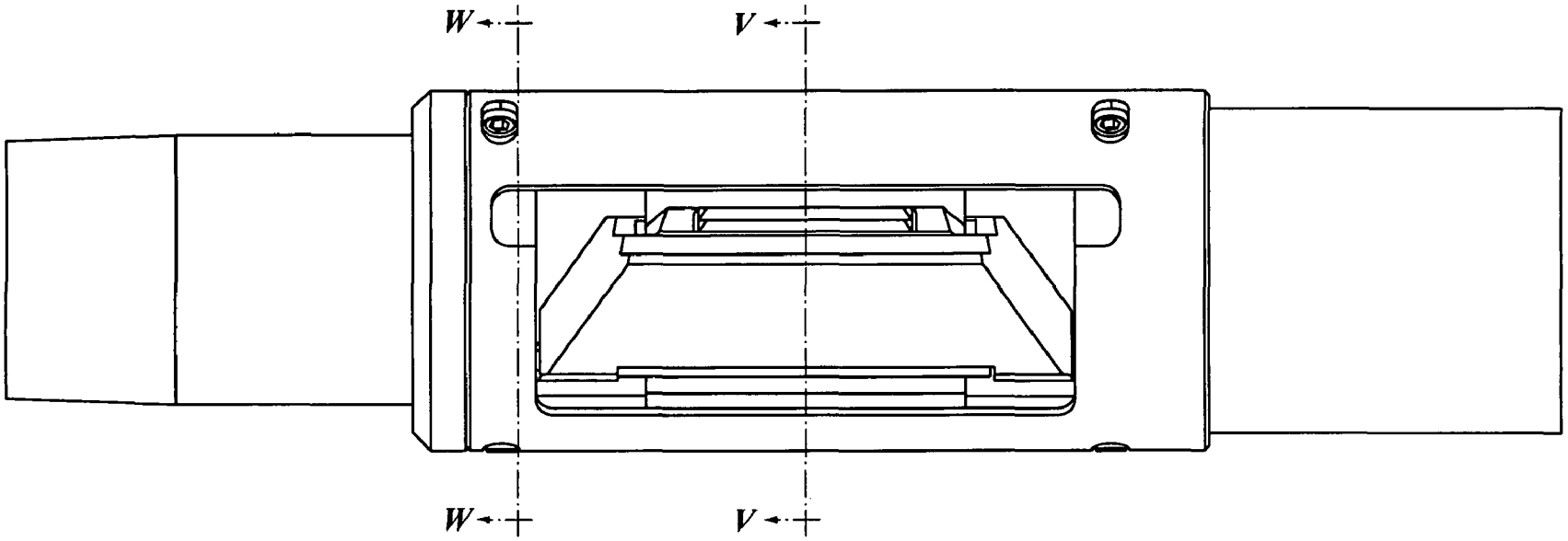
FIG. 37A is a side view of the example anchor assembly of FIG. 29.
Figure 37B:
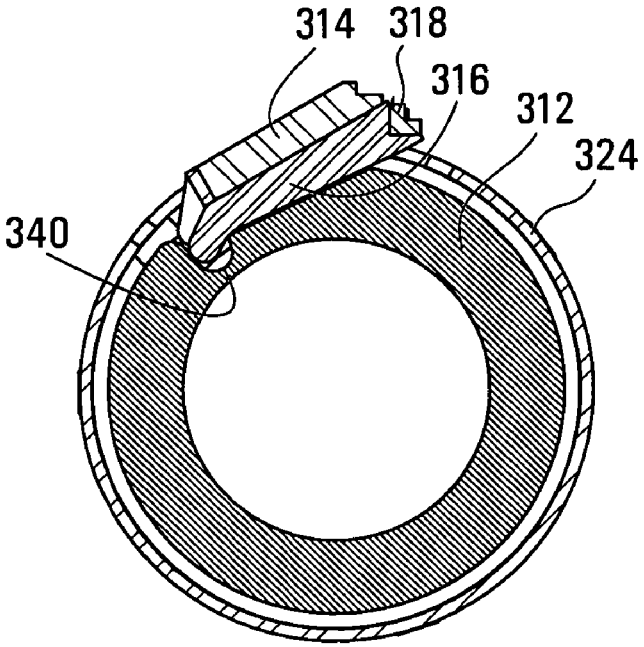
FIGS. 37B through 37E include cross-sectional views of the example anchor assembly of FIG. 29 along lines V-V and W-W of FIG. 37A, for different positions of the dual-block anchors.
Figure 37B:
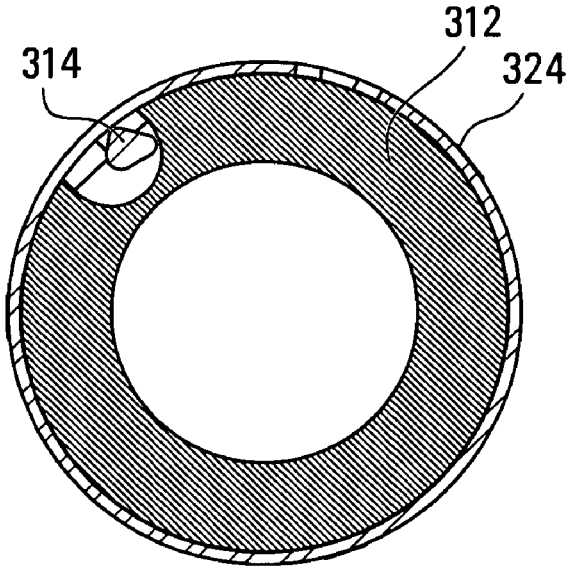
Figure 37C:
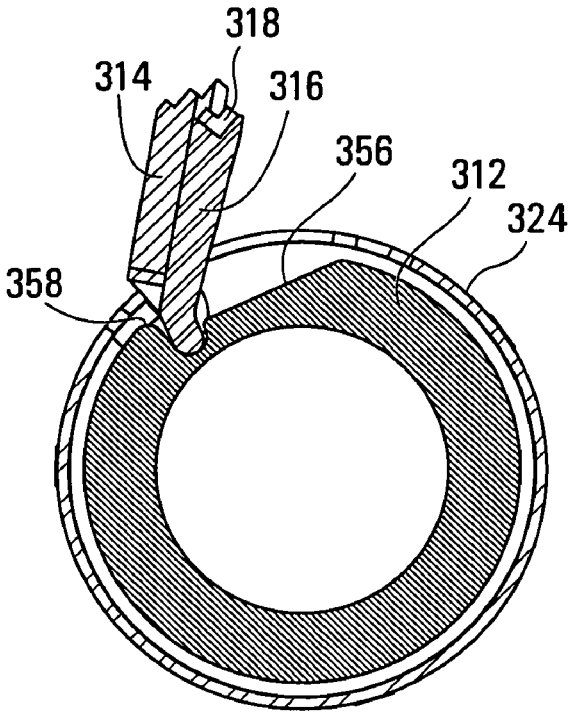
Figure 37C:
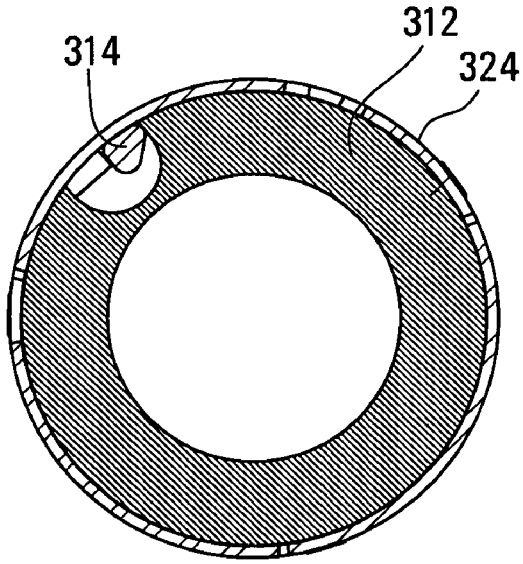
Figure 37D:
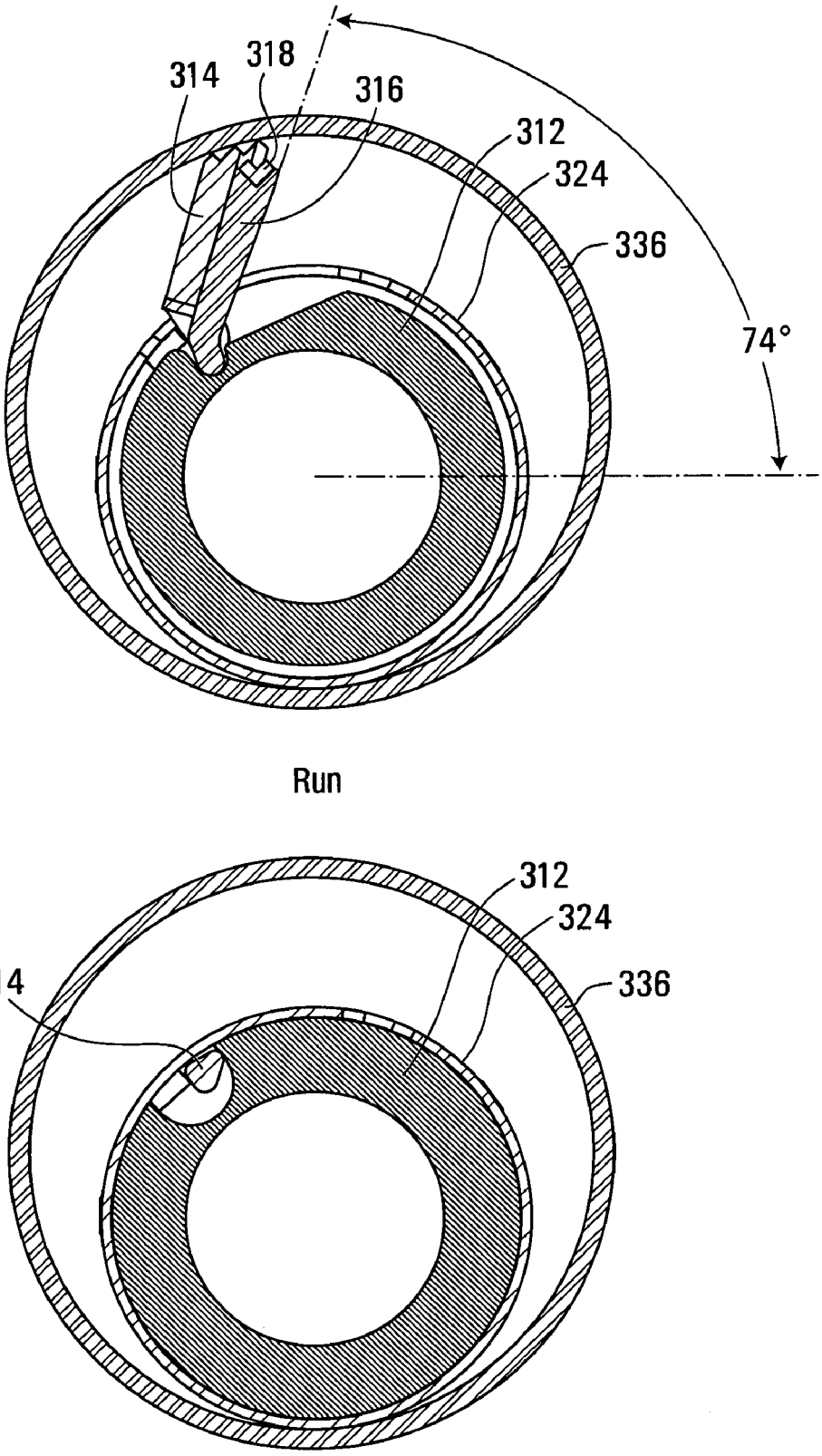
Figure 37E:
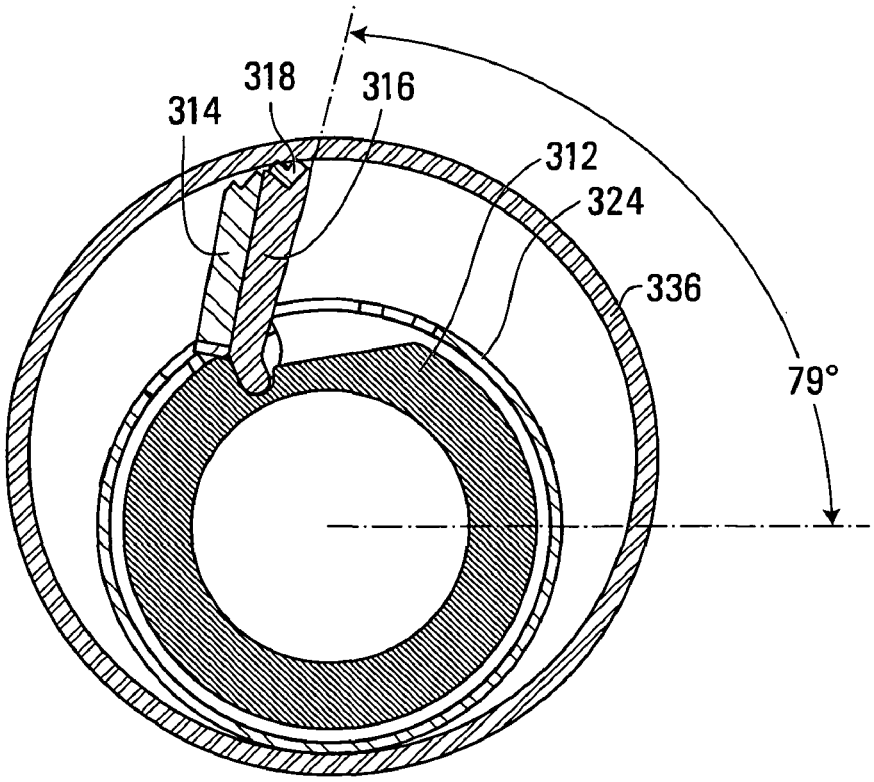
Figure 37E:
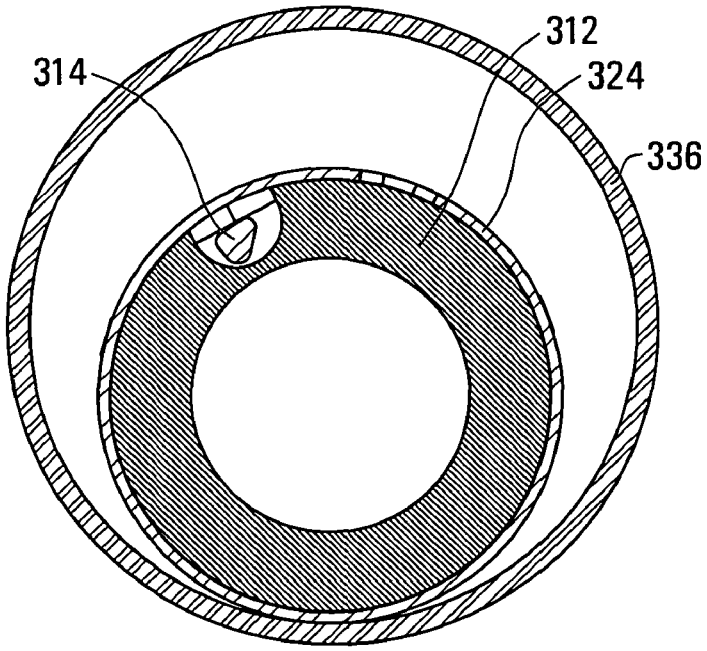

As noted above, a configuration having a single anchor and no bearings is also contemplated. An example anchor assembly 310 according to one such embodiment is shown in FIGS. 29 to 37E. FIG. 29 is a side view, FIG. 30 is an isometric view, FIG. 31 includes end and side views of the example anchor assembly 310 in a well bore, FIGS. 32 to 35 are respective cross-sectional views of the example anchor assembly 310 along lines R-R, S-S, T-T, U-U of FIG. 31, FIG. 36 is an exploded view, FIG. 37A is a side view, and FIGS. 37B through 37E include cross-sectional views along lines V-V and W-W of FIG. 37A, for different positions of the dual-block anchor.

The example anchor assembly 310 includes a drag block 314, an anchor block 316 with an insert 318, and a mandrel 312 which would be coupled to a tubing string. A housing 324 is retained on the mandrel 312 with fasteners, illustratively guide screws 332, which are installed in bores 346 in the mandrel and engage slots 334 in the housing. The housing 324 includes an opening 325 through which the dual-block anchor 350 extends, and also retains the dual-block anchor. The guide screws 332 and the slots 334 enable limited relative rotation between the mandrel 312 and the housing 324. The mandrel 312, as in previously described embodiments, includes a groove 340 which locates the anchor block 316 and provides a shoulder 358 for moving the anchor block into contact with the well bore 336, and slots, one of which is shown at 342 in FIG. 36, for receiving extensions of the drag block 314. The anchor assembly 310 is thus another example of an implementation in which slots are provided only in the mandrel 312 to accommodate the drag block extensions.

This configuration is substantially similar to the example anchor assembly 210, although with no bearings 228, 230. The housing 324 is used to retain the drag block 314 and the slots in the mandrel are used to guide the drag block. The mandrel 312 is still free to rotate inside the housing 324, as in the single set with bearings case, with the extent of rotation being limited in the example anchor assembly 310 by the guide screws 332 and the slots 334.

The dual-block anchor 350 may be the same as the dual-block anchor 250 described above. The function of the example anchor assembly 310 is also substantially the same as the anchor assembly 210. The housing 324 rests against the well bore 336, while the mandrel 312 is pushing the anchor block 316 into its set position. The housing 324 is then in stationary contact with the well bore 336 when the anchor assembly 310 is set, and will prevent wear of the well bore caused by vibrations and oscillations of the mandrel 312.

Operation of the anchor assembly 310 may otherwise be as described above, as will be apparent from FIGS. 37B to 37E, which show a collapsed position of the dual-block anchor 350 on the surface 356 of the mandrel 312, a free position of the anchor, a run position of the anchor, and a set position of the anchor.

Figure 38:
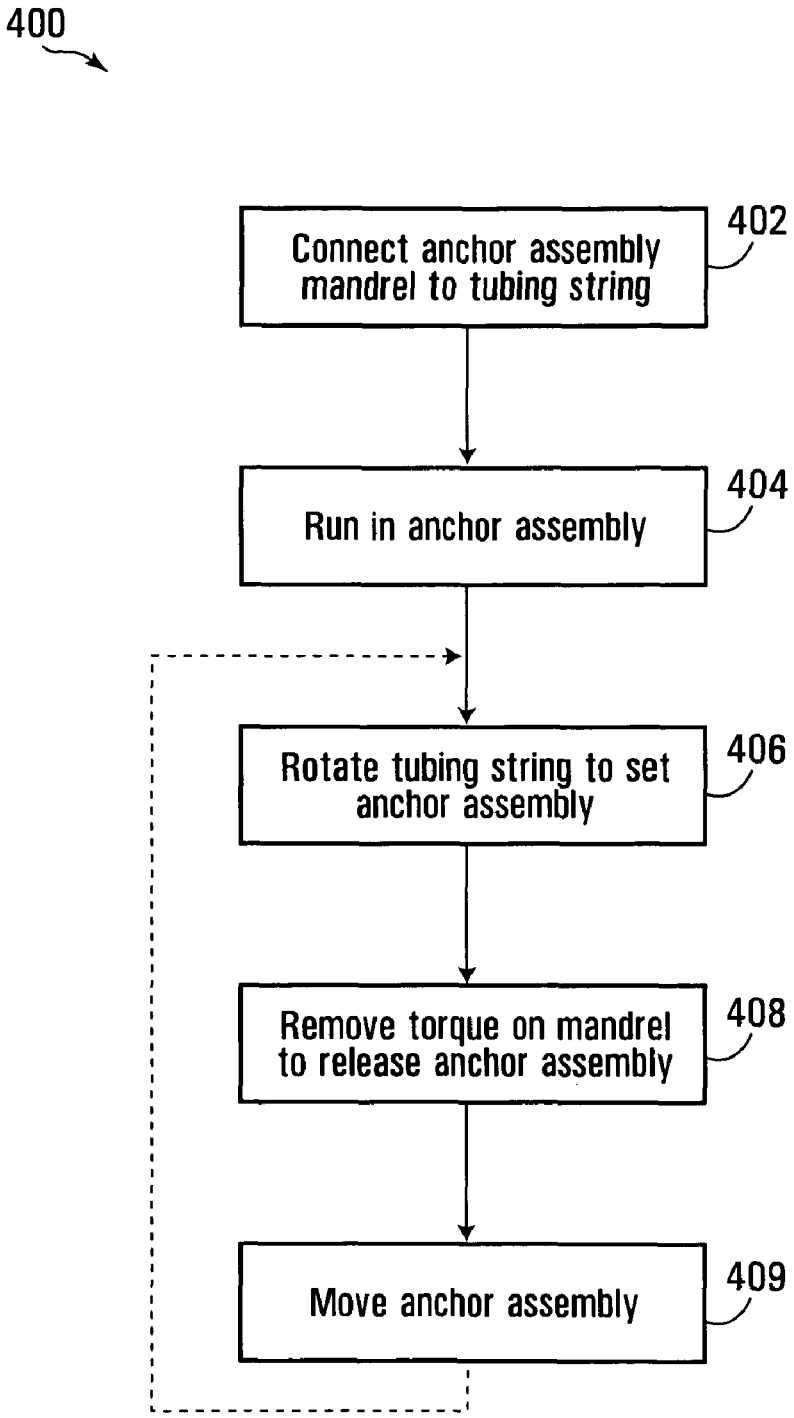
FIG. 38 is a flow diagram illustrating a method of operating an anchor assembly.

Although described above primarily in terms of anchors and anchor assemblies, aspects of the invention may also or instead be embodied in other forms, such as methods. FIG. 38 is a flow diagram illustrating a method of operating an anchor assembly.

The example method 400 involves an operation 402 of connecting a mandrel of an anchor assembly to a tubing string of a production well. The anchor assembly also includes an anchor block, a drag block, and a biasing arrangement. The anchor block is coupled to move, with rotation of the mandrel, between a run position out of contact with a well bore of the production well and a set position in contact with the well bore to set the downhole anchor assembly in the well bore. The drag block is coupled to the mandrel to contact the well bore at least when the anchor block is out of contact with the well bore. The biasing arrangement is provided to bias the anchor block away from the well bore and the drag block toward the well bore.

At 404, the anchor assembly is run into a well bore. When the anchor assembly has been moved, with the anchor block in the run position, to a desired downhole location, the tubing string is rotated at 406, to move the anchor block into the set position to set the anchor assembly at that downhole location.

Rotation of the tubing string at 406 applies and maintains a torque on the mandrel to keep the anchor assembly set at the desired location. Removing the torque from the mandrel, as shown at 408, allows the biasing arrangement to move the anchor block from the set position to the run position and thereby release the anchor assembly. The anchor assembly can then be moved at 409, either to the surface or to a second desired downhole location. The dashed line in FIG. 38 illustrates that the anchor assembly can be set at the second desired downhole location and subsequently released and moved.

Variations of the example method 400 may be or become apparent to those skilled in the art, from the foregoing description of anchors and anchor assemblies, for instance.

What has been described is merely illustrative of the application of principles of embodiments of the invention. Other arrangements and methods can be implemented by those skilled in the art without departing from the scope of the present invention.

For example, other embodiments may employ two dual-block anchors or more than three dual-block anchors, depending on the amount of support required. A desired amount of free space to be provided in a well bore may also influence a decision as to the number of anchors to use and/or their placement. An anchor assembly might employ two anchors toward one side of a housing, for instance, to provide additional support over the single set configuration while still providing a larger open area in a well bore to accommodate coiled tubing to free trapped downhole equipment.

Embodiments of the invention may also be used under any of various conditions. For example, anchor assemblies may be used in conjunction with different casing weights.

More generally, embodiments of the invention are in no way limited to the specific examples shown in the drawings and described above. Numbers, types, shapes, and/or relative locations of various elements may vary, for instance.

I claim:

1. A downhole anchor assembly for a tubing string, comprising:

a mandrel to be coupled to the tubing string, the mandrel comprising a shoulder along a groove on the mandrel;

an anchor block comprising a structure received in the groove, to be pushed by the shoulder with rotation of the mandrel for moving the anchor block from a run position out of contact with a well bore to a set position in contact with the well bore to set the downhole anchor assembly in the well bore, the anchor block further comprising extensions;

a drag block, coupled to the mandrel, the drag block comprising shoulders forming grooves that receive the extensions of the anchor block to slidably couple the anchor block and the drag block together; and a biasing arrangement to bias the anchor block away from the well bore and the drag block toward the well bore, the drag block extending beyond the anchor block in a direction along the drag block grooves toward the well bore and contacting the well bore when the anchor block is in the run position, the rotation of the mandrel to push the structure for moving the anchor block from the run position to the set position sliding the anchor block relative to the drag block to extend the anchor block beyond the drag block and into contact with the well bore.

2. The downhole anchor assembly of claim 1, wherein the structure of the anchor block is pushed by the shoulder of the mandrel to move the anchor block from the run position toward the set position with rotation of the mandrel in a predetermined direction.

3. The downhole anchor assembly of claim 2, wherein the mandrel is rotated in the predetermined direction by applying a torque to the mandrel, and wherein the biasing arrangement is coupled to move the anchor block from the set position toward the run position when the torque is removed from the mandrel by applying a force to the shoulder of the mandrel through the anchor block to rotate the mandrel in a direction opposite to the predetermined direction.

4. The downhole anchor assembly of claim 1, wherein the drag block and the anchor block comprise respective spring seat surfaces, and wherein the biasing arrangement comprises at least one spring positioned between the spring seat surfaces.

5. The downhole anchor assembly of claim 4, wherein the at least one spring comprises a coil spring or a leaf spring.

6. The downhole anchor assembly of claim 1, wherein the drag block comprises a plurality of spring seat surfaces, wherein the anchor block comprises a plurality of spring seat surfaces opposed to the plurality of spring seat surfaces of the drag block, and wherein the biasing arrangement comprises a plurality of springs respectively positioned between opposed pairs of the plurality of spring seat surfaces of the drag block and the plurality of spring seat surfaces of the anchor block.

7. The downhole anchor assembly of claim 2, wherein the structure of the anchor block and the shoulder of the mandrel are shaped to limit movement of the anchor block with rotation of the mandrel in the predetermined direction.

8. The downhole anchor assembly of claim 1, wherein the mandrel comprises a plurality of shoulders along respective grooves on the mandrel, the anchor assembly comprising a plurality of anchors, each anchor comprising a drag block coupled to the mandrel, an anchor block comprising a structure received in a respective one of the plurality of grooves on the mandrel, and a biasing arrangement to bias the drag block toward the well bore and the anchor block away from the well bore.

9. The downhole anchor assembly of claim 1, further comprising:

a housing at least partially enclosing the mandrel, the drag block, and the anchor block, the mandrel being rotatable relative to the housing, wherein the drag block is coupled to the mandrel by the housing.

10. The downhole anchor assembly of claim 9, wherein the drag block and the biasing arrangement retain the anchor block in contact with the mandrel.

11. The downhole anchor assembly of claim 9, further comprising bearings positioned between the housing and the mandrel, the bearings connecting the housing to the mandrel and allowing the mandrel to rotate relative to the housing.

12. The downhole anchor assembly of claim 9, further comprising:

a guide screw installed in a bore in the mandrel to engage a slot in the housing, the guide screw and the slot limiting an extent of relative rotation between the mandrel and the housing.

13. The downhole anchor assembly of claim 1, further comprising:

a pair of retaining rings coupled to the mandrel, the drag block being coupled to the mandrel by the pair of retaining rings, wherein the drag block and the biasing arrangement retain the anchor block in contact with the mandrel.

14. A method comprising:

connecting a mandrel of an anchor assembly to a tubing string of a production well, the mandrel comprising a shoulder along a groove on the mandrel, the anchor assembly further comprising:

an anchor block comprising a structure received in the groove, to be pushed by the shoulder with rotation of the mandrel for moving the anchor block from a run position out of contact with a well bore of the production well to a set position in contact with the well bore to set the downhole anchor assembly in the well bore, the anchor block further comprising extensions;

a drag block, coupled to the mandrel, the drag block comprising shoulders forming grooves that receive the extensions of the anchor block to slidably couple the anchor block and the drag block together; and a biasing arrangement to bias the anchor block away from the well bore and the drag block toward the well bore, the drag block extending beyond the anchor block in a direction along the drag block grooves toward the well bore and contacting the well bore when the anchor block is in the run position, the rotation of the mandrel to push the structure for moving the anchor block from the run position to the set position sliding the anchor block relative to the drag block to extend the anchor block beyond the drag block and into contact with the well bore;

moving the anchor assembly, with the anchor block in the run position, to a desired downhole location; and rotating the tubing string to move the anchor block into the set position to set the anchor assembly at the desired downhole location.

15. The method of claim 14, wherein rotating comprises rotating the tubing string to apply a torque to rotate the mandrel in a predetermined direction, the method further comprising:

removing the torque from the mandrel, to thereby allow the biasing arrangement to rotate the mandrel in a direction opposite to the predetermined direction, move the anchor block from the set position to the run position and release the anchor assembly.

16. The method of claim 15, further comprising:

moving the anchor assembly, with the anchor block in the run position, to a second desired downhole location; and rotating the tubing string in the predetermined direction to move the anchor block into the set position to set the anchor assembly at the second desired downhole location.

17. A downhole anchor comprising:

an anchor block comprising a structure to be received in a groove on a mandrel and pushed by a shoulder of the groove for moving the anchor block from a run position out of contact with a well bore to a set position in contact with the well bore to set the downhole anchor assembly in the well bore, the anchor block further comprising extensions;

a drag block, coupled to the anchor block, the drag block comprising shoulders forming grooves that receive the extensions of the anchor block to slidably couple the anchor block and the drag block together; and a biasing arrangement to bias the anchor block away from the well bore and the drag block toward the well bore, a well bore contacting portion of the drag block extending beyond a well bore contacting portion the anchor block in a direction along the drag block grooves when the anchor block is in the run position, the anchor block being movable, by rotation of the mandrel, from the run position to the set position by sliding the anchor block relative to the drag block to extend the well bore contacting portion of the anchor block beyond the well bore contacting portion of the drag block.

18. The downhole anchor of claim 17, wherein the drag block and the anchor block comprise respective spring seats, and wherein the biasing arrangement comprises at least one spring positioned between the spring seats.

19. The downhole anchor of claim 18, wherein the at least one spring comprises a coil spring or a leaf spring.

* * * * *